US010661558B2

(12) United States Patent
Chikamoto

(10) Patent No.: US 10,661,558 B2
(45) Date of Patent: May 26, 2020

(54) PIEZOELECTRIC PRINT HEAD AND PIEZOELECTRIC INK JET PRINTER

(71) Applicant: Seiko Epson Corporation, Tokyo (JP)

(72) Inventor: Motonori Chikamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/229,606

(22) Filed: Dec. 21, 2018

(65) Prior Publication Data

US 2019/0202201 A1 Jul. 4, 2019

(30) Foreign Application Priority Data

Dec. 28, 2017 (JP) ..... 2017-253574

(51) Int. Cl.
*B41J 2/045* (2006.01)
*B41J 2/14* (2006.01)

(52) U.S. Cl.
CPC ..... *B41J 2/04515* (2013.01); *B41J 2/04541* (2013.01); *B41J 2/04581* (2013.01); *B41J 2/14201* (2013.01); *B41J 2/14233* (2013.01)

(58) Field of Classification Search
CPC ..... B41J 2/04515; B41J 2/14201; B41J 2/14233; B41J 2/04581; B41J 2/04541
See application file for complete search history.

(56) References Cited

U.S. PATENT DOCUMENTS 5,519,416 A * 5/1996 Hayasaki ..... B41J 2/35 347/13
2008/0084434 A1 4/2008 Sheahan et al.
2012/0154489 A1 6/2012 Nakayama
2018/0111368 A1 4/2018 Chikamoto

FOREIGN PATENT DOCUMENTS

JP 2016-179575 A 10/2016
WO WO-2016-152145 A1 9/2016

OTHER PUBLICATIONS

Extended European Search Report for Application No. EP 18 24 8128 dated May 15, 2019 (9 pages).

* cited by examiner

*Primary Examiner* — Justin Seo
(74) *Attorney, Agent, or Firm* — Harness, Dickey & Pierce, P.L.C.

(57) ABSTRACT

A piezoelectric print head includes a first discharge section, a second discharge section, a third discharge section, a first switch, a second, and a third switch. The second discharge section is located between the first discharge section and the third discharge section, the first switch and the third switch are switched in accordance with a print signal in synchronization with a first clock, the second switch is switched in accordance with a print signal in synchronization with a second clock, in a first period, the print signal synchronized with the second clock is transferred and the print signal synchronized with the first clock is not transferred, and in a second period, the print signal synchronized with the second clock is not transferred and the print signal synchronized with the first clock is transferred.

10 Claims, 11 Drawing Sheets

<DECODED CONTENT IN DECODER>

| | PRINT DATA | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NON-RECORD | (0, 0) | L | H | L | L |

UB LB

PIEZOELECTRIC PRINT HEAD AND PIEZOELECTRIC INK JET PRINTER

This application claims priority to Japanese Patent Application No. 2017-253574 filed on Dec. 28, 2017. The entire disclosure of Japanese Patent Application No. 2017-253574 is hereby incorporated herein by reference.

BACKGROUND

1. Technical Field

The present invention relates to a piezoelectric print head and piezoelectric ink jet printer.

2. Related Art

Printing apparatuses for discharging ink to print images and documents are commonly used and such printing apparatuses include piezoelectric ink jet printers that use piezoelectric elements. These piezoelectric elements are provided to correspond to a plurality of discharge sections in a piezoelectric print head, and the individual piezoelectric elements are driven in accordance with a drive signal to discharge ink from nozzles of the discharge sections to form dots. To increase the density of nozzles, for example, a driver integrated circuit (IC) for driving piezoelectric elements is directly and integrally mounted on an actuator substrate that has flow channels of the discharge sections and piezoelectric elements (for example, see JP-A-2016-179575).

The increase in the number of nozzles to be driven due to the highly-densified nozzles increases the number of corresponding piezoelectric elements, and also increases the amount of electric current flowing through the wiring board such as a flexible printed circuit (FPC). The current increase causes the piezoelectric print head to be driven at a very high temperature. The high-temperature piezoelectric print head may cause various problems, for example, the properties of the ink may be changed due to high temperature, a material having high heat resistance is to be used for ink channel components, and a lot more engineering is required to design driver ICs such that the driver ICs can stably operate at high temperatures.

SUMMARY

An advantage of some aspects of the invention is that there is provided a piezoelectric print head that includes a first discharge section group having a plurality of first discharge sections each having a first nozzle configured to discharge liquid, a first pressure chamber communicating with the first nozzle, and a first piezoelectric element provided so as to correspond to the first pressure chamber to discharge the liquid, a second discharge section group having a plurality of second discharge sections each having a second nozzle configured to discharge liquid, a second pressure chamber communicating with the second nozzle, and a second piezoelectric element provided so as to correspond to the second pressure chamber to discharge the liquid, a third discharge section group having a plurality of third discharge sections each having a third nozzle configured to discharge liquid, a third pressure chamber communicating with the third nozzle, and a third piezoelectric element provided so as to correspond to the third pressure chamber to discharge the liquid, a first switch group having a plurality of first switches each configured to supply or not to supply a drive signal for driving the first piezoelectric element to the first piezoelectric element in accordance with a print signal transferred with a first clock, a second switch group having a plurality of second switches each configured to supply or not to supply a drive signal for driving the second piezoelectric element to the second piezoelectric element in accordance with a print signal transferred with a second clock, and a third switch group having a plurality of third switches each configured to supply or not to supply a drive signal for driving the third piezoelectric element to the third piezoelectric element in accordance with a print signal transferred with the first clock. The second discharge section group is located between the first discharge section group and the third discharge section group, and in a period in which the print signal is transferred with the second clock, the transfer of the print signal with the first clock is stopped.

In the piezoelectric print head, during a period, by stopping the print signal transfer operation in a (non-heat-generating) discharge section group located between discharge section groups that produce heat due to the transfer operation, no heat is produced by the non-heat-generating discharge section group. In other words, the heat-generating discharge section groups are separated by the non-heat-generating discharge section group. Accordingly, the heat dispersibility can be increased and the temperature rise in the piezoelectric print head can be suppressed. The discharge section groups to which the print signal transfer is stopped during the period can transfer the print signal during another period and accordingly the use of the two clock signals cause no print quality decrease.

In this aspect, a clock distribution circuit configured to distribute an original clock signal as the first clock or the second clock may be provided. With this configuration, in a circuit for controlling the piezoelectric print head, a known configuration may be used.

In this aspect, physical properties of the liquid may change at less than 100° C. When the liquid that is to be discharged from nozzles changes its physical properties at less than 100° C., heat generated by the transfer operation may cause a serious problem. With this configuration, however, the heat generation by the transfer operation can be suppressed to reduce the risk of change in the ink quality and stabilize the physical properties of the liquid to be discharged even if an ink that contains an alcohol-based liquid as a solvent having a boiling point between 70° C. and 90° C. is used, an ink that contains water as a solvent having a boiling point between 90° C. and 100° C. is used, or an ink that contain a solvent having a boiling point lower than those of the above-mentioned solvents is used.

In this aspect, 400 or more discharge sections may be arrayed in rows at a density of 300 or more per inch, and switches that correspond to the respective 400 or more discharge sections may be provided. In this configuration in which 400 or more discharge sections are arrayed in rows at a density of 300 or more per inch, the temperature per unit volume rises greatly due to the heat generated by the transfer operation of the print signal for each nozzle. With this configuration, however, the power consumption can be reduced by stopping part of the transfer operation and the heat generation can be suppressed. Accordingly, the risk of change in the ink quality due to the temperature rise in the piezoelectric print head can be reduced.

In this aspect, the drive signal may include a micro vibration waveform to be supplied to the piezoelectric element so as not to cause the liquid to be discharged. When the liquid, whose temperature has risen due to the heat generated in the piezoelectric print head, in the pressure chamber is discharged from the nozzles, the piezoelectric print head is refilled with liquid that has not been heated by the heat generated in the piezoelectric print head and has a temperature lower than that of the liquid that was filled before. As a result, the temperature in the piezoelectric print head decreases. On the other hand, the micro vibration does not cause the liquid to be discharged and the cooling effect by the discharge of the liquid and by the refill with the new liquid is not expected. As a result, the temperature rises relatively. However, without the micro vibration during the liquid-non-discharge state, the viscosity of the liquid may increase. With the above-described configuration, the heat generation in the overall piezoelectric print head can be suppressed and the heat generation in the liquid-non-discharge state can become less serious.

In this aspect, the piezoelectric print head may further include a fourth discharge section group having a plurality of fourth discharge sections each having a fourth nozzle configured to discharge liquid, a fourth pressure chamber communicating with the fourth nozzle, and a fourth piezoelectric element provided so as to correspond to the fourth pressure chamber to discharge the liquid, and a fourth switch group having a plurality of fourth switches each configured to supply or not to supply the drive signal for driving the fourth piezoelectric element to the fourth piezoelectric element in accordance with a print signal transferred with a third clock. The fourth discharge section group may be located between the first discharge section group and the third discharge section group, and in a period the print signal is transferred with the third clock signal, the transfer of the print signal with the first clock and the second clock may be stopped. With this configuration, the heat dispersibility can be increased and the temperature rise in the piezoelectric print head can be further suppressed.

In this aspect, the liquid may be ink and a piezoelectric ink jet printer that includes the above-described piezoelectric print head may be provided. With this configuration, the temperature rise in the piezoelectric print head can be suppressed and thereby the temperature rise of the ink can be suppressed and high-quality printing can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
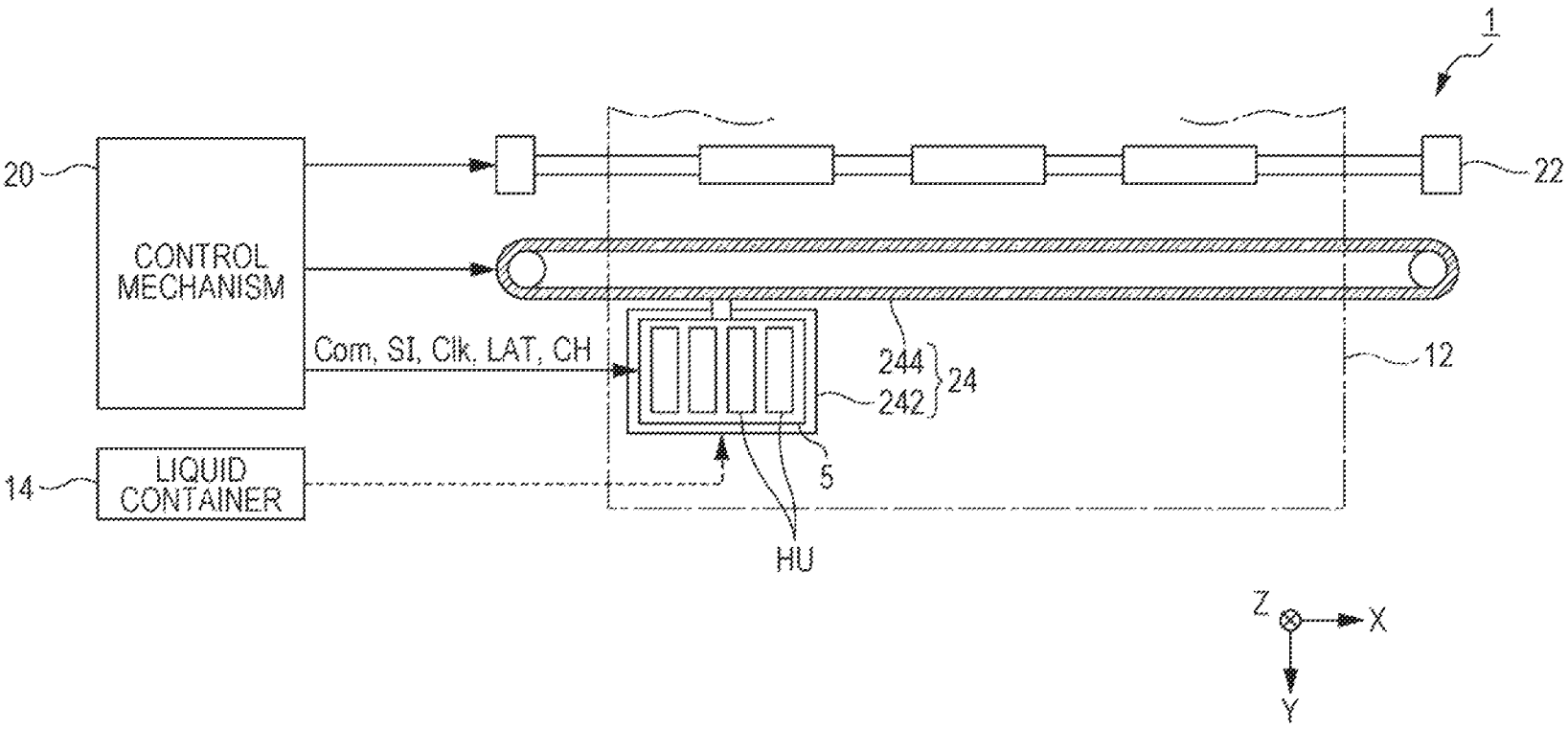
FIG. 1 illustrates a configuration of a piezoelectric ink jet printer according to an embodiment.

Hereinafter, embodiments of the invention will be described with reference to the drawings. In the drawings, the size and scaling ratio of each section are appropriately changed from those of actual sections. Although various technically preferred limitations are given in the embodiments described below in order to illustrate specific preferred examples of the invention, it should be noted that the scope of the invention is not intended to be limited to the embodiments unless such limitations are explicitly mentioned hereinafter.

FIG. 1 illustrates a configuration of a piezoelectric ink jet printer 1 according to an embodiment. The piezoelectric ink jet printer 1 discharges an ink, which is an example liquid, onto a medium 12. The medium 12 is typically a printing paper; alternatively, a print target such as a plastic film or cloth may be used.

As illustrated in FIG. 1, the piezoelectric ink jet printer 1 includes a liquid container 14 that stores ink. The liquid container 14 may be, for example, a cartridge that is detachably attached to the piezoelectric ink jet printer 1, a pouch-shaped ink pack formed of a flexible film, or an ink tank that can be refilled with ink. The liquid container 14 stores a plurality of inks of different colors.

The piezoelectric ink jet printer 1 also includes a control mechanism 20, a transport mechanism 22, a moving mechanism 24, and a plurality of piezoelectric print heads HU. The control mechanism 20 includes, for example, a processing circuit such as a central processing unit (CPU) or a field-programmable gate array (FPGA), and a storage circuit such as a semiconductor memory. The control mechanism 20 controls components in the piezoelectric ink jet printer 1. In this embodiment, the transport mechanism transports a medium 12 in a +Y direction under the control of the control mechanism 20. In the following description, the +Y direction and a −Y direction that is opposite to the +Y direction may be collectively referred to as a Y-axis direction.

The moving mechanism 24 reciprocates the plurality of piezoelectric print heads HU in a +X direction and a −X direction that is opposite to the +X direction under the control of the control mechanism 20. The +X direction is a direction that intersects the +Y direction in which the medium 12 is transported, typically, a direction that is orthogonal to the +Y direction. In the following description, the +X direction and the −X direction may be collectively referred to as an X-axis direction. The moving mechanism 24 includes a transport member 242 that accommodates the head section 5, and an endless belt 244 to which the transport member 242 is fixed. The liquid container 14 may be disposed in the transport member 242 together with the piezoelectric print heads HU.

The head section 5 includes a plurality of piezoelectric print heads HU. To each of the piezoelectric print heads HU, an ink is supplied from the liquid container 14. Furthermore, to each of the piezoelectric print heads HU, the following signals are supplied from the control mechanism 20. Specifically, from the control mechanism 20 to each piezoelectric print head HU, a print signal SI for determining an amount of ink to be discharged from each nozzle (including zero for non-discharge), a clock signal Clk to be used to transfer the print signal SI, and a signal LAT and signal CH for determining a print period and the like are supplied. Each piezoelectric print head HU is driven by a drive signal Com under the control of the print signal SI, the signal LAT, and the signal CH to discharge ink in the +Z direction from a part or all of the nozzles.

The print signal SI is classified into print signals SI-1 to SI-4 in this embodiment as will be described below; however, the print signals SI may be expressed as a print signal SI when the print signals SI are collectively expressed without distinguishing the signals. The +Z direction is a direction that intersects a plane that is defined by the X direction and +Y direction, for example, a direction orthogonal to the plane. In the following description, the +Z direction and a −Z direction that is opposite to the +Z direction may be collectively referred to as a Z-axis direction.

Each piezoelectric print head HU forms a desired image onto a surface of the medium 12 by discharging ink from the nozzles onto the surface of the medium 12 in conjunction with the transport of the medium 12 by the transport mechanism 22 and the reciprocation of the transport member 242. In this embodiment, a high-density piezoelectric print head HU is employed as will be described below in detail. The expression "high-density" means that nozzles for discharging ink are provided at a density of 300 or more per inch.

In the piezoelectric print head HU, the drive signal Com is selectively supplied to the piezoelectric elements via a switch such as a transmission gate. As the number of the nozzles increases due to the highly densified nozzles, the amount of transfer of the print signal SI, which defines an amount of discharge of ink from each nozzle, per unit time also increases. To cope with the increase in the transfer amount, the frequency of the clock signal Clk may be increased; however, the configuration in which the frequency of the clock signal Clk is merely increased may cause all shift registers corresponding to the nozzles to operate at high speed and the piezoelectric print head HD may consume more power, and this may be one of heat generation factors.

With the increase in the temperature of the piezoelectric print head HU due to heat generation, the temperature of the ink also increases due to thermal conduction. The ink temperature change causes the ink to change its physical properties such as composition and viscosity and increases the risk of change in the ink quality. The piezoelectric print head HU has a great advantage over thermal print heads in that the piezoelectric print heads can discharge ink without heating the ink, and accordingly, many inks used in the piezoelectric print heads are heat-sensitive. Consequently, the physical properties of the inks are likely to be affected by generated heat and if the physical properties change, the print quality may decrease and may cause a failure.

Especially, in the piezoelectric print head HU that has the high-density nozzles, as the amount of generated heat increases, the efficiency of heat conduction to the ink increases whereas the ability to discharge the waste heat to the outside decreases, and this may cause a serious problem.

In another case, if an ink non-discharge state continues, the viscosity of the ink increases and the nozzles may be clogged with the ink. To solve the problems, in some cases, the piezoelectric elements are driven to vibrate the ink to suppress sedimentation while no ink is discharged. This operation may be referred to as micro vibration. When the print signal SI designates micro vibration, the heat generated in switches and shift registers is conducted to the ink while the ink is not discharged. In the ink discharge, the ink whose temperature has risen is discharged to the outside and the print head HU is refilled with ink having a relatively low temperature and as a result, the temperature in the nozzles decreases, whereas in the micro vibration, the temperature decrease by the ink discharge is not be expected.

In this embodiment, the print signal SI is sequentially transferred in accordance with a clock signal Clk in cascade-connected flip-flops as will be described below and the clock signal Clk is supplied only to a part of the flip-flop circuits. The operation of flip-flops to which no clock signal is supplied is stopped and the overall heat generation amount can be reduced. As described above, the heat generation in the piezoelectric print head HU can be reduced and various inks can be used in the piezoelectric ink jet printer 1 according to the embodiment. For example, an ink that contains a liquid whose physical properties change at less than 100° C. may be selected. Furthermore, for example, an ink that contains an alcohol-based liquid as a solvent having a boiling point between 70° C. and 90° C., an ink that contains water as a solvent having a boiling point between 90° C. and 100° C., or an ink that contain a solvent having a boiling point lower than those of the above-mentioned solvents may be selected.

Figure 2:
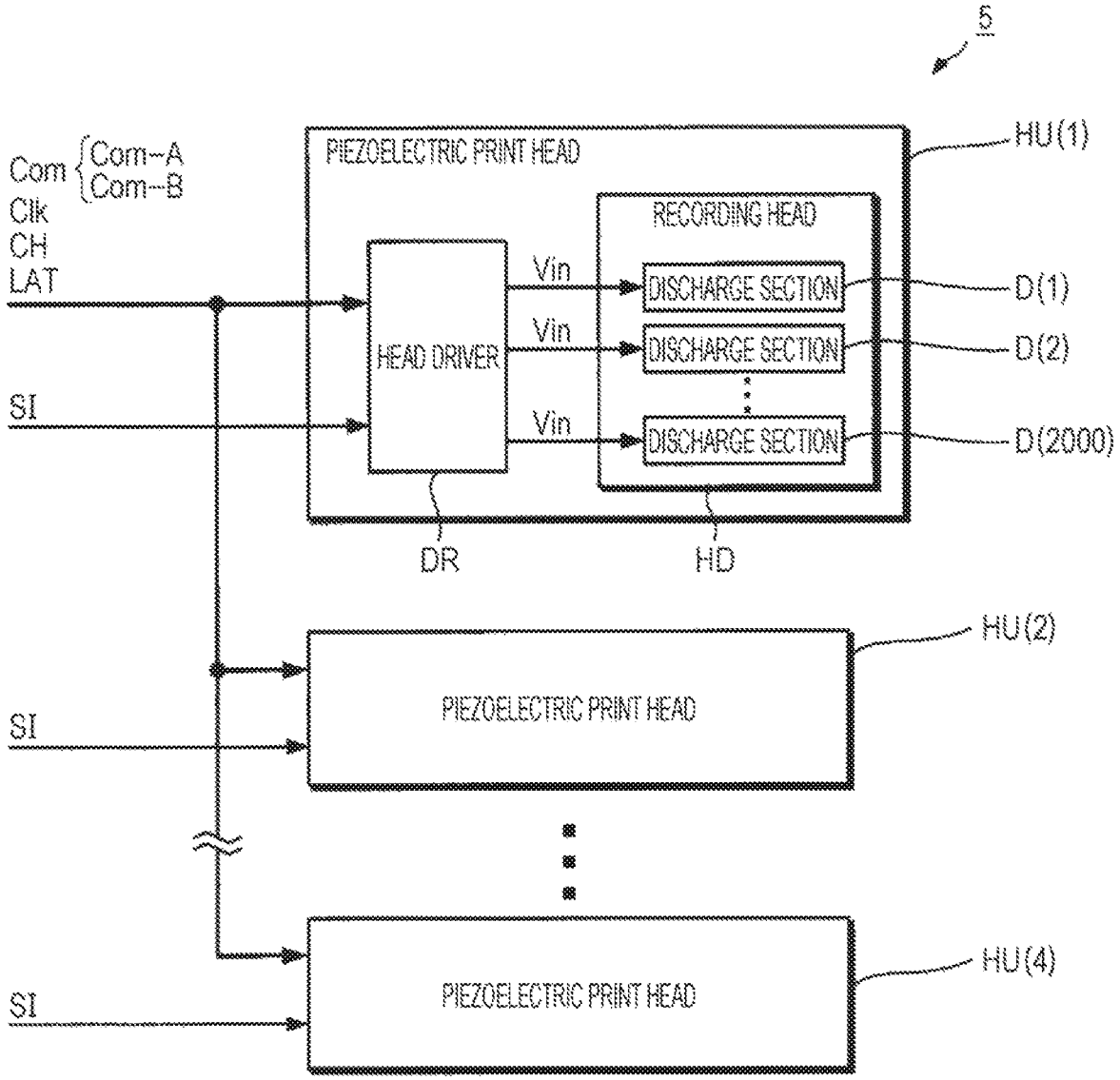
FIG. 2 is a block diagram illustrating an electric configuration of a head section.

FIG. 2 is a block diagram illustrating an electric configuration of the head section 5. As illustrated in FIG. 2, the head section 5 includes piezoelectric print heads HU(1) to HU(4). The electrical configurations of the piezoelectric print heads HU(1) to HU(4) are similar to each other, and an electrical configuration of the piezoelectric print head HU(1) will be described as an example. The piezoelectric print head HU(1) includes a head driver DR and a recording head HD. In this embodiment, the recording head HD includes 2000 discharge sections D. In order to distinguish the 2000 discharge sections D, the discharge sections D may be sequentially referred to as a first stage, a second stage, . . . , 2000th stage. Furthermore, in the following description, a discharge section D in a m-th stage in a discharge section D in the recording head HD may be referred to as a discharge section D(m), in which the variable m is a natural number that satisfies $1 \leq m \leq 2000$. For example, a discharge section in the third stage is expressed as a discharge section D(3).

The drive signal Com, the clock signal Clk, the signal CH, and the signal LAT are commonly supplied from the control mechanism 20 to each head driver DR in the piezoelectric print heads HU(1) to HU(4). The print signal SI is supplied to each of the print heads HU(1) to HU(4). The print signal SI corresponds to each of the discharge sections D(1) to D(2000) in the piezoelectric print head HU(1) in a one-to-one relationship to determine an amount of ink to be discharged from each of the discharge sections D(1) to D(2000).

The drive signal Com is an analog signal that has a plurality of waveforms for driving the discharge sections D. The drive signal Com includes a drive signal Com-A and a drive signal Com-B (see FIG. 8). The control mechanism 20 includes a digital-to-analog (D/A) conversion circuit (not illustrated) and converts a digital drive waveform signal generated by a CPU or the like in the control mechanism 20 into an analog drive signal Com and outputs the signal.

The head driver DR generates individual drive signals Vin for driving each of the discharge sections D(1) to D(2000) in the recording head HD based on the drive signal Com, the print signal SI, the signal CH, and the signal LAT that are supplied from the control mechanism 20. In this embodiment, the head section 5 includes the four piezoelectric print heads HU(1) to HU(4); however, the number of the piezoelectric print heads is not limited to four. Similarly, the number of the discharge sections D in the recording head HD is not limited to 2000.

Figure 3:
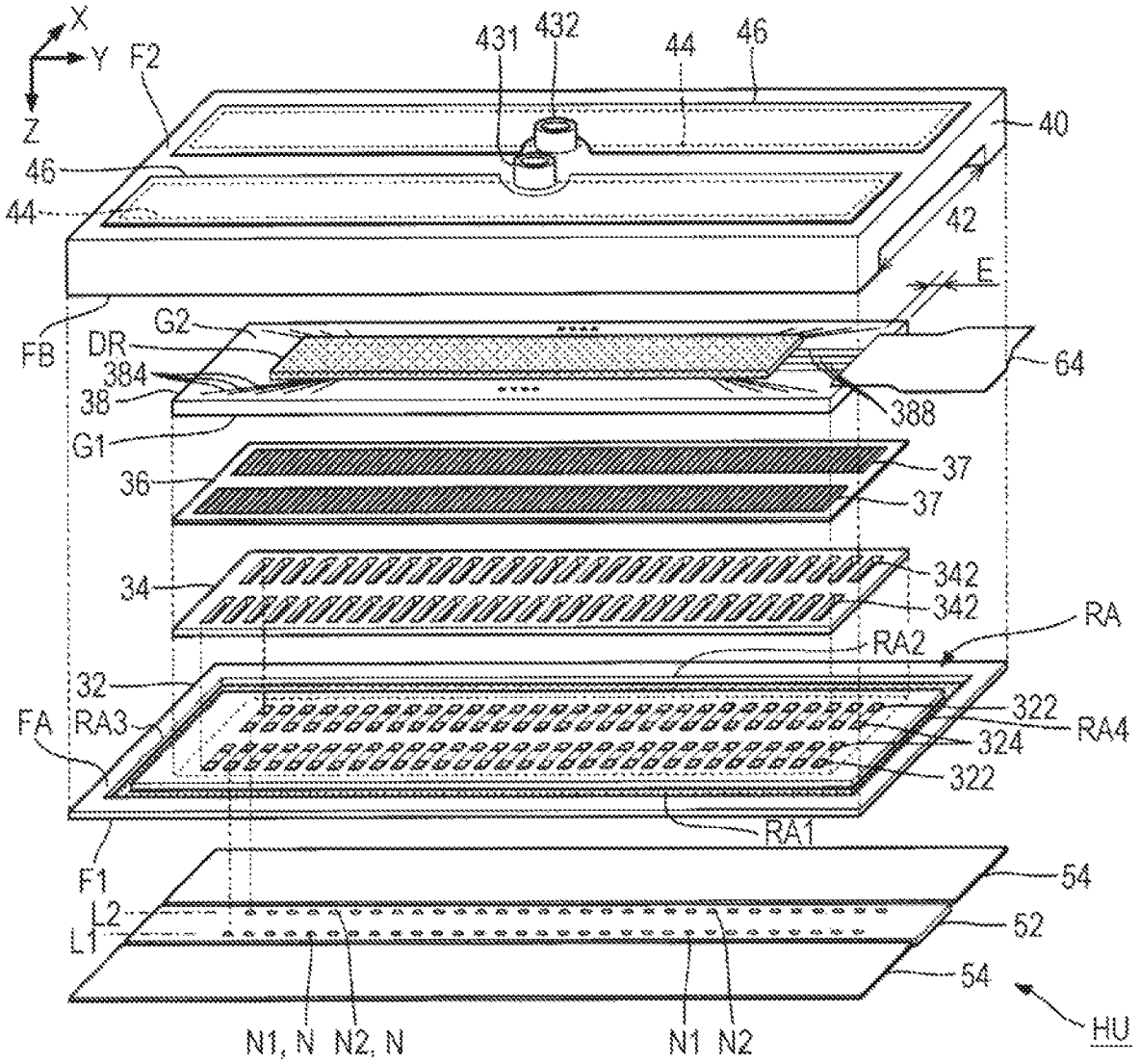
FIG. 3 is an exploded perspective view of a piezoelectric print head.
Figure 4:
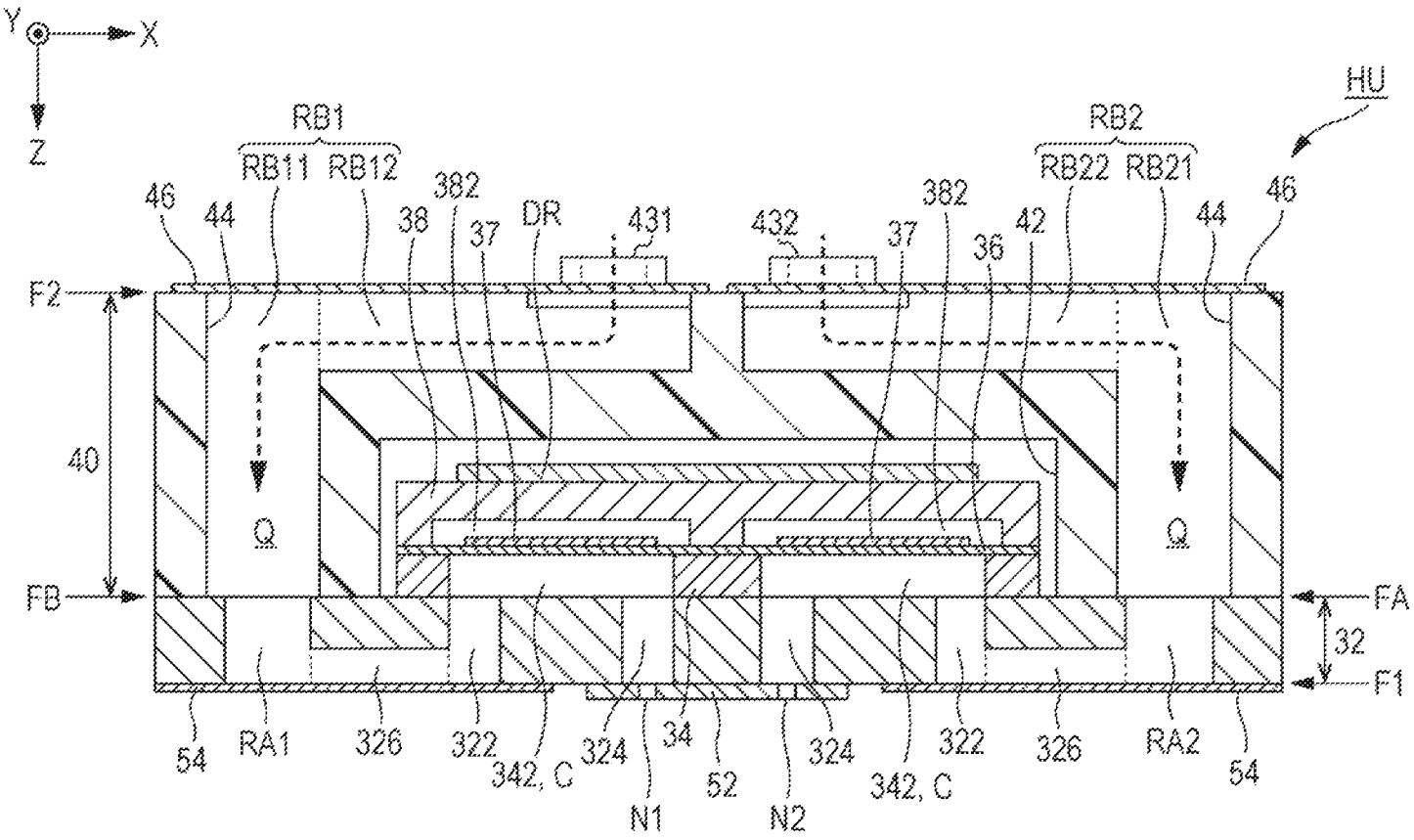
FIG. 4 is a cross-sectional view of a piezoelectric print head.

FIG. 3 is an exploded perspective view of the piezoelectric print head HU. FIG. 4 is a cross-sectional view of the piezoelectric print head HU taken along the XZ plane in FIG. 3. As illustrated in FIG. 3, the piezoelectric print head HU includes 2000 nozzles N that are aligned in two rows in the Y-axis direction. In the description below, the two rows may be referred to as a row L1 and a row L2, and each of the 1000 nozzles N in the row L1 may be referred to as a nozzle N1, and each of the 1000 nozzles N in the row L2 may be referred to as a nozzle N2. In this embodiment, it is assumed that, in the Y-axis direction, a position of a j-th nozzle N1 from the −Y side among the 1000 nozzles N1 in the row L1 substantially corresponds to a position of a j-th nozzle N2 from the −Y side among the 1000 nozzles N2 in the row L2. Here, the variable j is a natural number that satisfies $1 \leq j \leq 1000$. In this description, "substantially corresponds" includes a case in which two positions exactly correspond to each other and a case in which it can be considered that one position corresponds to the other position if an error is considered. In the Y-axis direction, a position of a j-th nozzle N1 from the −Y side among the 1000 nozzles N1 in the row L1 and a position of a j-th nozzle N2 from the −Y side among the 1000 nozzles N2 in the row L2 may be aligned in two staggered rows.

The piezoelectric print head HU includes a flow channel plate 32 as illustrated in FIG. 3 and FIG. 4. The flow channel plate 32 is a plate-like member that has a side F1 and a side FA. The side F1 is a surface on the +Z side, that is, viewed from the piezoelectric print head HU, a front surface that faces the medium 12 and the side FA is a surface (−Z side) opposite to the side F1. On the side FA, a pressure chamber plate 34, a vibration section 36, a plurality of piezoelectric elements 37, a protection member 38, and a casing section 40 are disposed. On the side F1, a nozzle plate 52 and a vibration absorber 54 are disposed. Each component in the piezoelectric print head HU is typically a plate-like member that is elongated in the Y direction similarly to the flow channel plate 32, and these components are bonded together, for example, with an adhesive. The direction in which the flow channel plate 32, the pressure chamber plate 34, the protection member 38, and the nozzle plate 52 are stacked may be the Z-axis direction.

The nozzle plate 52 is a plate-like member that has the 2000 nozzles N. The nozzle plate 52 is disposed on the side F1 of the flow channel plate 32, for example, with an adhesive. Each nozzle N is a through-hole in the nozzle plate 52. The nozzle plate 52 is manufactured, for example, by processing a single crystal substrate of silicon (Si) by using a semiconductor manufacturing technique such as etching. Note that any known material and manufacturing method may be employed for manufacturing the nozzle plate 52. In this embodiment, in the nozzle plate 52, the 1000 nozzles N that correspond to the row L1 and the 1000 nozzles N that correspond to the row L2 are provided at a density of 300 or more nozzles N per inch in each row.

The flow channel plate 32 is a plate-like member in which flow channels for ink are provided. As illustrated in FIG. 3 and FIG. 4, a flow channel RA is formed in the flow channel plate 32. The flow channel RA includes a flow channel RA1 that corresponds to the row L1, a flow channel RA2 that corresponds to the row L2, a flow channel RA3 that connects the flow channel RA1 and the flow channel RA2, and a flow channel RA4 that connects the flow channel RA1 and the flow channel RA2. The flow channel RA1 is an opening that is elongated in the Y-axis direction. The flow channel RA2 is an opening that is elongated in the Y-axis direction and located in the +X direction viewed from the flow channel RA1.

In the flow channel plate 32, flow channels 322 and flow channels 324 are disposed so as to correspond to the nozzles N in a one-to-one relationship. As illustrated in FIG. 4, the flow channel 322 and the flow channel 324 are openings that pass through the flow channel plate 32. The flow channel 324 communicates with the nozzles N that corresponds to the flow channel 324. On the side F1 of the flow channel plate 32, two flow channels 326 are provided as illustrated in FIG. 4. One of the two flow channels 326 connects the flow channel RA1 and the flow channel 322 that corresponds to the nozzles N1 in the row L1 in a one-to-one relationship, and the other one of the two flow channels 326 connects the flow channel RA2 and the flow channel 322 that corresponds to the nozzles N2 in the row L2 in a one-to-one relationship.

The pressure chamber plate 34 is a plate-like member that has openings 342 so as to correspond to the nozzles N in a one-to-one relationship. The pressure chamber plate 34 is disposed on the side FA of the flow channel plate 32, for example, with an adhesive. The flow channel plate 32 and the pressure chamber plate 34 are manufactured, for example, by processing a single crystal substrate of silicon (Si) by using a semiconductor manufacturing technique respectively. Any known material and manufacturing method may be employed for manufacturing the flow channel plate 32 and the pressure chamber plate 34.

The vibration section 36 is disposed on a surface, which is opposite to the side of the flow channel plate 32, of the pressure chamber plate 34. The vibration section 36 is a plate-like member that can elastically vibrate. In the plate-like member that constitutes the vibration section 36, parts of the plate-like member that correspond to the openings 342 in the plate-thickness direction may be selectively removed to integrally form the pressure chamber plate 34 and the vibration section 36.

As illustrated in FIG. 4, the side FA of the flow channel plate 32 and the vibration section 36 face each other with a space inside each opening 342. The space between the side FA of the flow channel plate 32 and the vibration section 36 inside the opening 342 functions as a pressure chamber C for applying pressure to the ink filled in the space. The pressure chamber C is, for example, a space that is defined by the X-axis direction as a lengthwise direction and the Y-axis direction as a widthwise direction. The piezoelectric print head HU has 2000 pressure chambers C so as to correspond to the 2000 nozzles N in a one-to-one relationship. As illustrated in FIG. 4, the pressure chamber C corresponding to the nozzle N1 communicates with the flow channel RA1 via the flow channel 322 and the flow channel 326 and also communicates with the nozzle N1 via the flow channel 324. The pressure chamber C corresponding to the nozzle N2 communicates with the flow channel RA2 via the flow channel 322 and the flow channel 326 and also communicates with the nozzle N2 via the flow channel 324.

On the side of the vibration section 36 opposite to the side facing the pressure chamber C, 2000 piezoelectric elements 37 are disposed so as to correspond to the 2000 pressure chambers C in a one-to-one relationship. The piezoelectric element 37 is deformed in response to a supply of the drive signal Com. The vibration section 36 vibrates in conjunction with the deformation of the piezoelectric element 37. The vibration of the vibration section 36 causes the pressure chamber C to change the pressure in the pressure chamber C. The changes in pressure in the pressure chamber C cause the ink filled in the pressure chamber C to be discharged via the flow channel 324 and the nozzle N. In this embodiment, for example, by the drive signal Com, the piezoelectric elements 37 are driven to discharge the ink from the nozzles N 30000 times or more per second. The discharge section D that is a physical mechanism for discharging ink includes the pressure chamber C, the flow channel 322, the nozzle N, the vibration section 36, and the piezoelectric element 37.

The protection member 38 is a plate-like member for protecting the 2000 piezoelectric elements 37 in the vibration section 36. The protection member 38 is disposed on the vibration section 36 or the pressure chamber plate 34. The protection member 38 is manufactured, for example, by processing a single crystal substrate of silicon (Si) by using a semiconductor manufacturing technique. Any known material and manufacturing method may be employed for manufacturing the protection member 38.

On a side G1 that is the +Z side of the protection member 38, two accommodating spaces 382 are formed. One of the two accommodating spaces 382 is a space for accommodating the piezoelectric elements 37 corresponding to the nozzles N1, and the other one of the two accommodating spaces 382 is a space for accommodating the piezoelectric elements 37 corresponding to the nozzles N2. When the protection member 38 is disposed on the discharge sections, the accommodating spaces 382 function as sealing spaces for preventing the piezoelectric elements 37 from deteriorating due to the influence of oxygen, moisture, or the like. The height of the accommodating spaces 382 in the Z-axis direction is high enough to prevent the piezoelectric elements 37 and the protection member 38 from coming into contact with each other when the piezoelectric elements 37 are deformed. With this structure, when the piezoelectric elements 37 are deformed, the noise caused by the deformation of the piezoelectric elements 37 can be reduced or prevented from propagating to the outside of the accommodating spaces 382.

On a side G2 that is the −Z side of the protection member 38, the head driver DR is disposed. In other words, the protection member 38 functions as a circuit board on which the head driver DR is mounted. The head driver DR selects to supply or not to supply the drive signal Com to each piezoelectric element 37 in accordance with the print signal SI. In this embodiment, the drive signal Com is generated in the control mechanism 20; however, the embodiment is not limited to this configuration and alternatively, the drive signal Com may be generated in the head driver DR.

On the side G2 of the protection member 38, wires 384 are provided, for example, so as to correspond to each piezoelectric element 37 in a one-to-one relationship. One end of the wire 384 is electrically connected to the head driver DR. The other end of the wire 384 is electrically connected to a connection terminal that is provided on the side G1 via a contact hole that passes through the protection member 38. The connection terminal is electrically connected to one electrode of the piezoelectric element 37. The drive signal Com that is output from the head driver DR is supplied to one end of the piezoelectric element 37, specifically, one of two electrodes, via the wire 384, the conduction hole, and the connection terminal.

On the side G2 of the protection member 38, a plurality of wires 388 are formed. Each of the one ends of the wires 388 is electrically connected to the head driver DR. Each of the other ends of the wires 388 extends to an area E that is an end portion of the side G2 of the protection member 38 in the +Y direction. To the area E on the side G2, a wiring member 64 is joined. The wiring member 64 is a component on which a plurality of wires that electrically connects the control mechanism 20 and the head driver DR are formed. The wiring member 64 may be a flexible wiring board, for example, a flexible printed circuit (FPC) or a flexible flat cable (FFC).

The casing section 40 is a case for storing ink to be supplied to each pressure chamber C and to each nozzle N. A side FB that is the +Z side of the casing section 40 is fixed to the side FA of the flow channel plate 32, for example, with an adhesive. On the side FB of the casing section 40, a grooved recessed portion 42 that extends in the Y-axis direction is formed. The protection member 38 and the head driver DR are accommodated inside the recessed portion 42. The wiring member 64, which is joined to the area E of the protection member 38, extends in the Y-axis direction to the inside of the recessed portion 42.

In this embodiment, the casing section 40 is formed of a material different from those of the flow channel plate and the pressure chamber plate 34. For example, the casing section 40 is formed of a resin material by injection molding. Any known material and manufacturing method may be employed for manufacturing the casing section 40. It is preferable that the casing section 40 be formed of, for example, a synthetic fiber such as polyparaphenylene benzobisoxazole (Zyron (registered trademark)) or a resin material such as a liquid crystal polymer.

On a side F2 that is the −Z side of the casing section 40, inlets 431 and 432 for introducing ink from the liquid container 14 are provided. In the casing section 40, a flow channel RB1 and a flow channel RB2 are formed. The flow channel RB1 includes a flow channel RB11 that communicates with the flow channel RA1 and a flow channel RB12 that communicates with the inlet 431. The flow channel RB2 includes a flow channel RB21 that communicates with the flow channel RA2 and a flow channel RB22 that communicates with the inlet 432. The flow channel RB1 and the flow channel RB2 function as reservoirs Q that store the ink to be supplied to the pressure chambers C. As illustrated in FIG. 4, the protection member 38 and the head driver DR are disposed in a space between the flow channel RB11 and the flow channel RB21.

As indicated by the dashed arrow in FIG. 4, the ink supplied from the liquid container 14 to the inlet 431 flows into the flow channel RA1 via the flow channel RB12 and the flow channel RB11. A part of the ink flowing into the flow channel RA1 is supplied to the pressure chamber C that corresponds to the nozzle N1 via the flow channel 326 and the flow channel 322. The ink filled in the pressure chamber C corresponding to the nozzle N1 flows, for example, through the flow channel 324 in the +Z direction and is discharged from the nozzle N1 by deformation of the piezoelectric element 37. Similarly, the ink supplied from the liquid container 14 to the inlet 432 flows into the flow channel RA2 via the flow channel RB22 and the flow channel RB21. A part of the ink flowing into the flow channel RA2 is supplied to the pressure chamber C that correspond to the nozzle N2 via the flow channel 326 and the flow channel 322. The ink filled in the pressure chamber C corresponding to the nozzle N2 flows, for example, through the flow channel 324 in the +Z direction and is discharged from the nozzle N2 by deformation of the piezoelectric element 37.

On the side F2 of the casing section 40, the above-described inlets 431 and 432 are formed and openings 44 that correspond to the reservoirs Q are formed. On the side F2 of the casing section 40, two vibration absorbers 46 are disposed so as to block the openings 44. Each vibration absorber 46 is a flexible film that absorbs pressure fluctuation of the ink in the reservoir Q and is a wall surface of the reservoir Q. On the side F1 of the flow channel plate 32, two vibration absorbers 54 are disposed so as to block the flow channel RA1, the flow channel RA2, the flow channels 326, and the flow channels 322. Each vibration absorber 54 is a flexible film that absorbs pressure fluctuation of the ink in the reservoir Q and is a wall surface of the reservoir Q.

Figure 5:
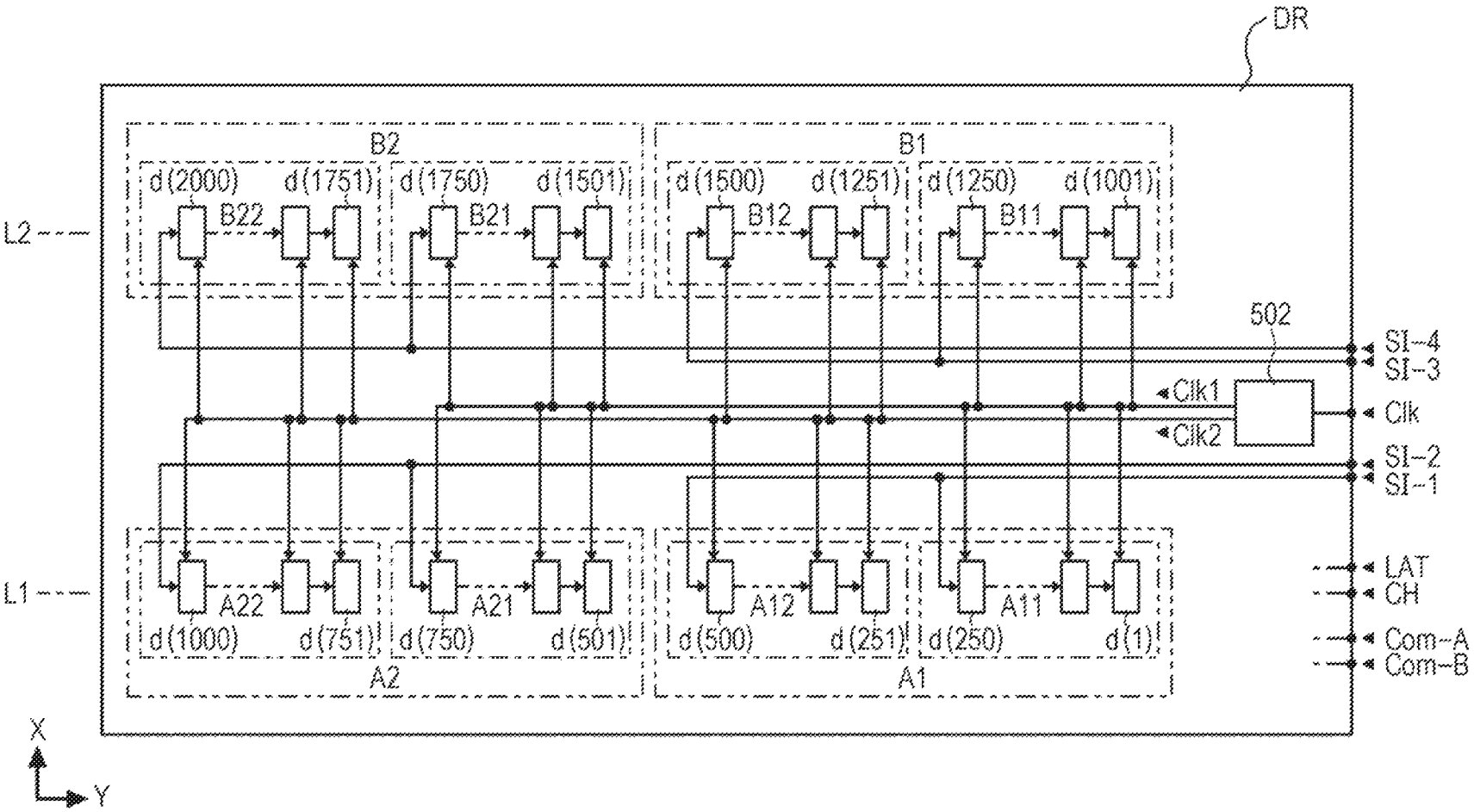
FIG. 5 is a block diagram illustrating an electric configuration of a head driver.

FIG. 5 is a block diagram illustrating a schematic electric configuration of the head driver DR. The block diagram illustrates a layout of each component in the head driver DR when the head driver DR is viewed in the +Z direction in plan view in FIG. 4.

As illustrated in FIG. 5, in the head driver DR, to an end portion in the +Y direction, that is, a right end in FIG. 5, the signals described below are supplied from the control mechanism 20 via the wiring member 64 and the wires 388 (see FIG. 3). Specifically, to the head driver DR, the print signals SI-1 to SI-4, the clock signal Clk, the signal LAT, the signal CH, the drive signal Com-A, and the drive signal Com-B are supplied.

In this embodiment, the head driver DR is divided into a clock distribution circuit 502 and four large blocks A1, A2, B1, and B2. The clock distribution circuit 502 distributes the clock signal Clk as a clock signal Clk1 and a clock signal Clk2. The operation of the clock distribution circuit 502 will be described in detail below.

For the sake of simplicity, in the head driver DR, a discharge circuit for electrically drives the piezoelectric element 37 in a discharge section D(m) is expressed as d(m). In the four large blocks A1, A2, B1, and B2, the large blocks A1 and A2 correspond to the row L1, and the large blocks B1 and B2 correspond to the row L2.

The large block A1 is further divided into small blocks A11 and A12. The small block A11 is a group of discharge circuits d(1) to d(250), and the small block A12 is a group of discharge circuits d(251) to d(500). The clock signal Clk1 is supplied to each of the discharge circuits d(1) to d(250), and the clock signal Clk2 is supplied to each of the discharge circuits d(251) to d(500). The print signals SI-1 is supplied to the discharge circuits d(250) and d(500). The print signal SI-1 defines amounts of ink to be discharged from the nozzles of the discharge sections D(1) to D(500). The large block A2 is further divided into small blocks A21 and A22. The small block A21 is a group of discharge circuits d(501) to d(750), and the small block A22 is a group of discharge circuits d(751) to d(1000). The clock signal Clk1 is supplied to each of the discharge circuits d(501) to d(750), and the clock signal Clk2 is supplied to each of the discharge circuits d(751) to d(1000). The print signals SI-2 is supplied to the discharge circuits d(750) and d(1000). The print signal SI-2 defines amounts of ink to be discharged from the nozzles of the discharge sections D(501) to D(1000). The large block B1 is further divided into small blocks B11 and B12. The small block B11 is a group of discharge circuits d(1001) to d(1250), and the small block B12 is a group of discharge circuits d(1251) to d(1500). The clock signal Clk1 is supplied to each of the discharge circuits d(1000) to d(1250), and the clock signal Clk2 is supplied to each of the discharge circuits d(1251) to d(1500). The print signals SI-3 is supplied to the discharge circuits d(1250) and d(1500). The print signal SI-3 defines amounts of ink to be discharged from the nozzles of the discharge sections D(1001) to D(1500). The large block B2 is further divided into small blocks B21 and B22. The small block B21 is a group of discharge circuits d(1501) to d(1750), and the small block B22 is a group of discharge circuits d(1751) to d(2000). The clock signal Clk1 is supplied to each of the discharge circuits d(1501) to d(1750), and the clock signal Clk2 is supplied to each of the discharge circuits d(1751) to d(2000). The print signals SI-4 is supplied to the discharge circuits d(1750) and d(2000). The print signal SI-4 defines amounts of ink to be discharged from the nozzles of the discharge sections D(1501) to D(2000). To each of the discharge circuits d(0) to d(2000), the signal LAT, the signal CH, the drive signal Com-A, and the drive signal Com-B are commonly supplied, although not illustrated in FIG. 5 for the sake of simplicity.

In this embodiment, for one dot, an ink is discharged up to twice from one nozzle N to express a four-level gray scale: a large dot, a medium dot, a small dot, and non-recording. To express the four-level gray scale, in this embodiment, two types of drive signals Com-A and Com-B are used. One cycle of each of the drive signal Com-A and the drive signal Com-B has a first-half pattern and a second-half pattern. In the first half and the second half of the one cycle, the drive signal Com-A or the drive signal Com-B is selected (or not selected) depending on the gray scale to be expressed and supplied to the piezoelectric element 37. First, the drive signal Com-A and the drive signal Com-B will be described and then the discharge circuit d for selecting the drive signal Com-A or the drive signal Com-B will be described.

Figure 8:
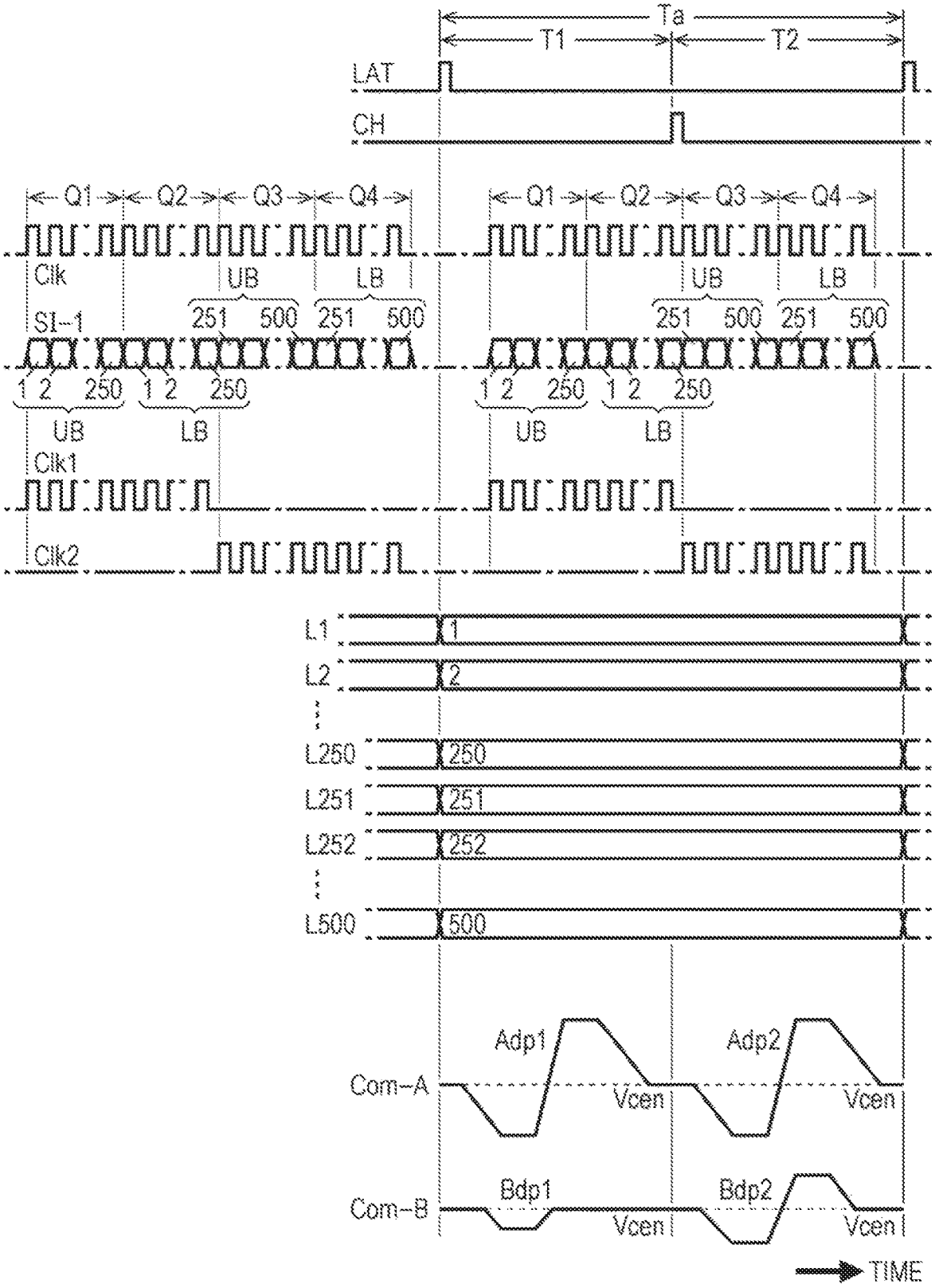
FIG. 8 is a timing chart illustrating operation of a head driver.

FIG. 8 illustrates a relationship between waveforms of the drive signals Com-A and Com-B and print periods. A print period Ta is a period from an output of a signal LAT to an output of a next signal LAT and a unit period necessary to express one of four-level gray scales with the ink discharged from one nozzle N. The first half of the print period Ta is a period T1 from an output of a signal LAT to an output of a signal CH, and the second half of the print period Ta is a period T2 from the output of the signal CH to an output of a next signal LAT.

The drive signal Com-A has a waveform in which a trapezoidal waveform Adp1 in the period T1 and a trapezoidal waveform Adp2 in the period T2 are repeated. The trapezoidal waveforms Adp1 and Adp2 according to the embodiment are substantially the same waveforms, and if the trapezoidal waveform Adp1 and the trapezoidal waveform Adp2 are supplied to one end of the piezoelectric element 37, medium amounts of ink are discharged respectively from the nozzle N that corresponds to the piezoelectric element 37.

The drive signal Com-B has a waveform in which a trapezoidal waveform Bdp1 in the period T1 and a trapezoidal waveform Bdp2 in the period T2 are repeated. The trapezoidal waveforms Bdp1 and Bdp2 according to the embodiment have different waveforms. The trapezoidal waveform Bdp1 causes the ink around the nozzle N to slightly vibrate to prevent the increase in ink viscosity. Consequently, when the trapezoidal waveform Bdp1 is supplied to one end of the piezoelectric element 37, no ink is discharged from the nozzle N that corresponds to the piezoelectric element 37. The trapezoidal waveform Bdp2 has a waveform different from those of the trapezoidal waveform Adp1 and the trapezoidal waveform Adp2. When the trapezoidal waveform Bdp2 is supplied to one end of the piezoelectric element 37, an amount of ink smaller than the medium amount is discharged from the nozzle N that corresponds to the piezoelectric element 37.

The voltage at the start of the trapezoidal waveforms Adp1, Adp2, Bdp1, and Bdp2 and the voltage at the end of the trapezoidal waveforms Adp1, Adp2, Bdp1, and Bdp2 are common, that is, a voltage Vcen. In other words, each of the trapezoidal waveforms Adp1, Adp2, Bdp1, and Bdp2 has a waveform that starts at the voltage Vcen and ends at the voltage Vcen.

In this embodiment, in the print period Ta, the four-level gray scales are expressed by the amounts of ink discharged from one nozzle N, and two-bit print data is supplied to one nozzle. In the two-bit print data, an upper bit is expressed as UB and a lower bit is expressed as LB.

As illustrated in FIG. 8, in the print period Ta, a clock signal Clk of 1000 shots is supplied. The period during which the clock signal Clk of 1000 shots is supplied is divided into four quarters Q1 to Q4 with 250 shots respectively. The clock distribution circuit 502 distributes a clock signal Clk as a clock signal Clk1 in the quarters Q1 and Q2 and as a clock signal Clk2 in the quarters Q3 and Q4. To distribute the clock signal Clk, for example, a counter for counting the clock signal Clk may be provided in the clock distribution circuit 502, and in a period in which a counting result is 500 or less, the clock signal Clk is distributed as the clock signal Clk1, and in a period in which a counting result is 501 or more, the clock signal Clk is distributed as the clock signal Clk2 and the counting is reset with the signal LAT.

The print signal SI-1 defines a bit UB and a lower bit of print data that corresponds each nozzle of the discharge circuits d(1) to d(500) in synchronization with the clock signal Clk, for example, in the following order. Specifically, the print signal SI-1 sequentially defines a bit UB in the quarter Q1 and sequentially defines a bit LB in the quarter Q2 in the print data that corresponds to each nozzle in the discharge circuits d(1) to d(250). Then, the print signal SI-1 sequentially defines a bit UB in the quarter Q3 and sequentially defines a bit LB in the quarter Q4 in the print data that corresponds to each nozzle in the discharge circuits d(251) to d(500).

Although not illustrated, the print signal SI-2 sequentially defines a bit UB in the quarter Q1 and sequentially defines a bit LB in the quarter Q2 in the print data that corresponds to each nozzle in the discharge circuits d(501) to d(750). Then, the print signal SI-2 sequentially defines a bit UB in the quarter Q3 and sequentially defines a bit LB in the quarter Q4 in the print data that corresponds to each nozzle in the discharge circuits d(751) to d(1000). Similarly, the print signal SI-sequentially defines a bit UB in the quarter Q1 and sequentially defines a bit LB in the quarter Q2 in the print data that corresponds to each nozzle in the discharge circuits d(1001) to d(1250). Then, the print signal SI-3 sequentially defines a bit UB in the quarter Q3 and sequentially defines a bit LB in the quarter Q4 in the print data that corresponds to each nozzle in the discharge circuits d(1251) to d(1500). Similarly, the print signal SI-4 sequentially defines a bit UB in the quarter Q1 and sequentially defines a bit LB in the quarter Q2 in the print data that corresponds to each nozzle in the discharge circuits d(1501) to d(1750). Then, the print signal SI-4 sequentially defines a bit UB in the quarter Q3 and sequentially defines a bit LB in the quarter Q4 in the print data that corresponds to each nozzle in the discharge circuits d(1751) to d(2000).

Next, the discharge circuit d that selects one of the drive signal Com-A and the drive signal Com-B and supplies the selected signal to the piezoelectric element 37 will be described. The configurations of the discharge circuits d(0) to d(2000) are similar and only clock signals and print signals to be supplied are different. Accordingly, the discharge circuits d(1) to d(250) in the small block A11 will be described as an example of the discharge circuits d(0) to d(2000).

Figure 6:
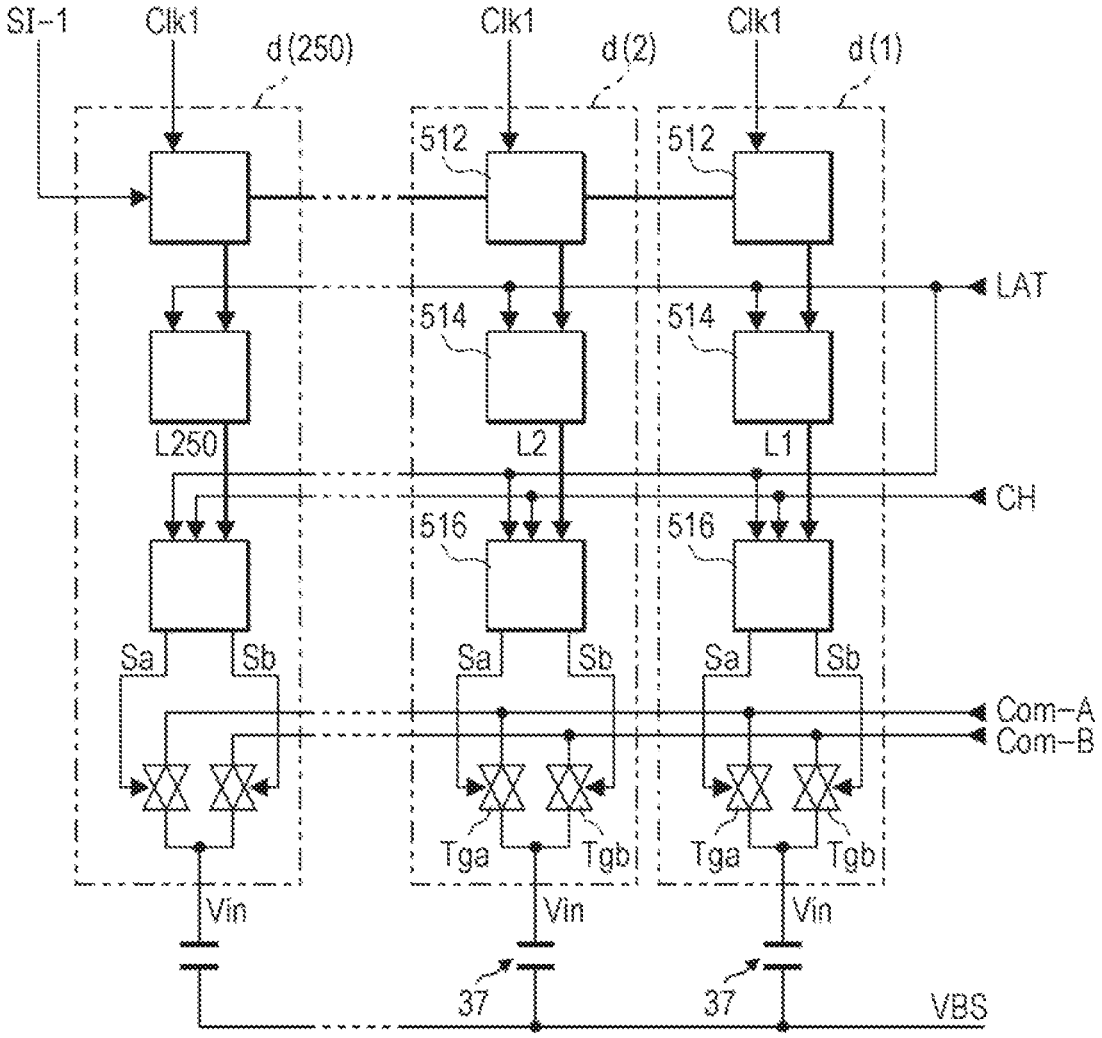
FIG. 6 is a block diagram illustrating an electric configuration of a discharge circuit.

FIG. 6 is a block diagram illustrating an electrical configuration of the discharge circuits d(1) to d(250) in the small block A11. As described above, the clock signal Clk1, the signal LAT, the signal CH, the drive signal Com-A, and the drive signal Com-B are supplied to each of the discharge circuits d(1) to d(250) in the small block A11, and the print signal SI-1 is supplied to the discharge circuit d(250).

Each of the discharge circuits d(1) to d(250) has a transfer circuit 512, a latch circuit 514, a decoder 516, and a pair of transmission gates Tga and Tgb.

Figure 7:
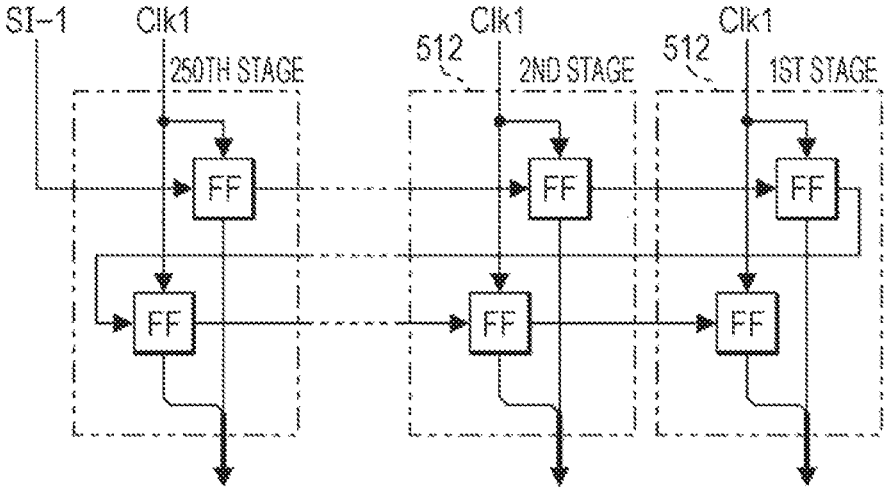
FIG. 7 is a block diagram illustrating an electric configuration of a transfer circuit.

FIG. 7 is a block diagram illustrating the transfer circuits 512 in the discharge circuits d(1) to d(250) in detail. As illustrated in FIG. 7, each of the transfer circuits 512 in the discharge circuits d(1) to d(250) has two flip-flops FF. In this configuration, the small block A11 includes a total of 500 flip-flops FF.

The 500 flip-flops FF are connected in cascade as described below. Specifically, as illustrated in FIG. 7, the 500 flip-flops FF are connected in cascade starting from the 250th stage to which the print signal SI-1 is supplied, to the 249th stage (not illustrated), the second stage, the first stage, the 250th stage, the 249th stage, . . . , the second stage, and the first stage. Each of the flip-flops FF, for example, stores an input signal at a timing of falling of the clock signal Clk1 and transfers the stored signal to the flip-flop FF in the next stage.

When the print signal SI-1 is serially supplied in synchronization with the clock signal Clk as illustrated in FIG. 8, in each flip-flop FF in the small block A11, the print signal SI-1 is sequentially shifted to the next stage every time the clock signal Clk is supplied for one cycle.

Consequently, when the print signal SI-1 is supplied in synchronization with the clock signal Clk1 of 500 shots in the quarters Q1 and Q2, the following signals are stored in each flip-flop FF. Specifically, in the two flip-flops FF in each stage in the small block A11, the flip-flop FF on the upstream side stores the lower bit LB of the print data of the corresponding stage and the flip-flop FF on the downstream side stores the upper bit UB of the print data of the corresponding stage.

Although not particularly illustrated in FIG. 8, in the quarters Q1 and Q2, in synchronization with the clock signal Clk1, the signal SI-2 is supplied to the small block A21, the signal SI-3 is supplied to the small block B11, and the signal SI-4 is supplied to the small block B21. When the clock signal Clk1 of 500 shots is supplied, in the two flip-flops FF in each stage in the small blocks A21, B11, and B21, the flip-flop FF on the upstream side stores the lower bit LB of the print data of the corresponding stage and the flip-flop FF on the downstream side stores the upper bit UB of the print data of the corresponding stage.

When the signal SI-1 is supplied from the quarter Q3 to the quarter Q4 in synchronization with the clock signal Clk2 of 500 shots, in the two flip-flops FF in each stage in the small blocks A12, the flip-flop FF on the upstream side stores the lower bit LB of the print data of the corresponding stage and the flip-flop FF on the downstream side stores the upper bit UB of the print data of the corresponding stage. Although not particularly illustrated in FIG. 8, in the quarters Q3 and Q4, in synchronization with the clock signal Clk2, the signal SI-2 is supplied to the small block A22, the signal SI-3 is supplied to the small block B12, and the signal SI-4 is supplied to the small block B22. When the clock signal Clk2 of 500 shots is supplied, in the two flip-flops FF in each stage in the small blocks A22, B12, and B22, the flip-flop FF on the upstream side stores the lower bit LB of the print data of the corresponding stage and the flip-flop FF on the downstream side stores the upper bit UB of the print data of the corresponding stage.

After the quarter Q4 is processed, in each stage in the small blocks A11, A12, A21, A22, B11, B12, B21, and B22, the flip-flop FF on the upstream side stores the lower bit LB of the print data and the flip-flop FF on the downstream side stores the upper bit UB of the print data.

Returning to FIG. 6, the latch circuit 514 in each stage latches the print data SI that has been stored in the two flip-flops FF in the transfer circuit 512 at a timing of rising of the signal LAT. In FIG. 6, the two bits that have been latched by the latch circuits 514 in the first to 250th stage are expressed as L1 to L250 respectively. In FIG. 8, the two bits that have been stored in the latch circuits 514 in the first to 500th stages in the small block A11 and the small block A12 are expressed as L1 to L500.

The decoder 516 in each stage decodes the two-bit print data that has been latched by the latch circuit 514 and outputs selection signals Sa and Sb for each of the periods T1 and T2 that are defined by the signal LAT and the signal CH to specify selection of drive signals for the transmission gates Tga and Tgb that function as a switch. Specifically, the selection signal Sa becomes high to specify to turn on the transmission gate Tga and becomes low to specify to turn off the transmission gate Tga. Similarly, the selection signal Sb becomes high to specify to turn on the transmission gate Tgb and becomes low to specify to turn off the transmission gate Tgb.

The drive signal Com-A is supplied to an input end of the transmission gate Tga, and the drive signal Com-B is supplied to an input end of the transmission gate Tgb. Output ends of the transmission gates Tga and Tgb are commonly connected to one end of the piezoelectric element of the corresponding stage. The other ends of the piezoelectric elements 37 are commonly connected and a voltage VBS is applied.

Figures 9, 10:
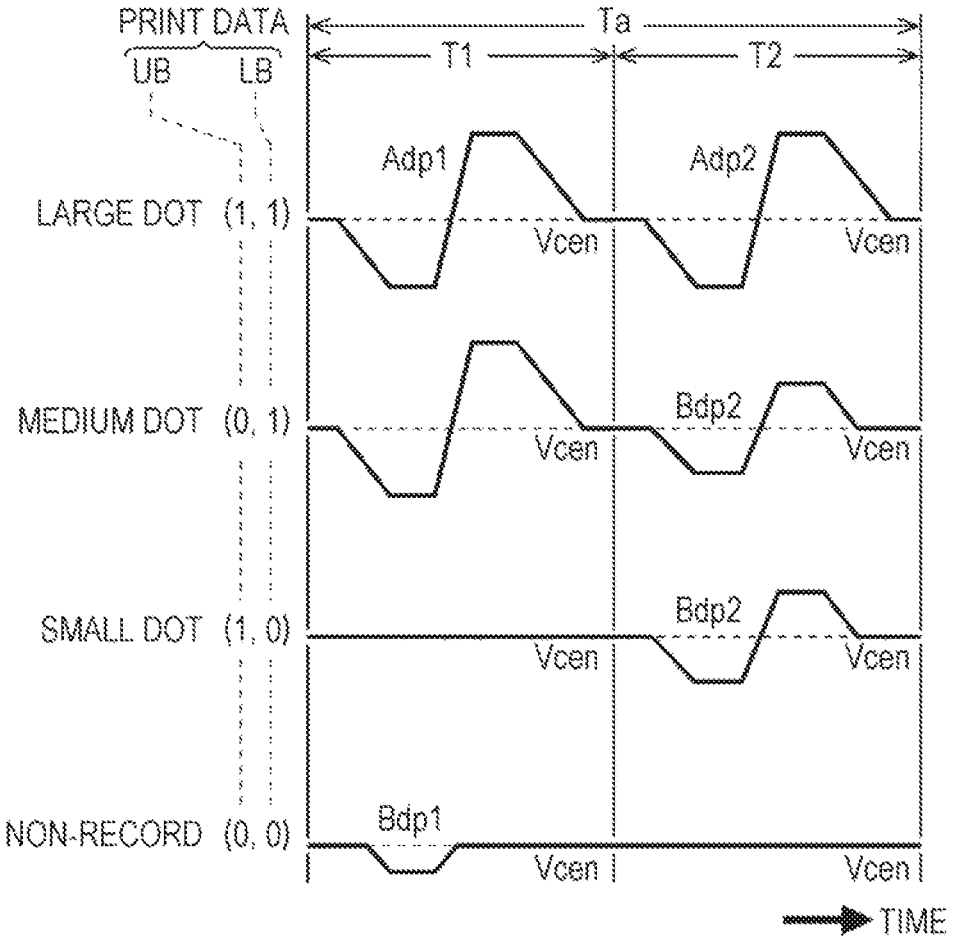
FIG. 9 illustrates a content decoded by a decoder.
FIG. 10 illustrates drive signals to be supplied to a piezoelectric element.

FIG. 9 illustrates a content decoded by the decoder 516. In FIG. 9, latched two-bit print data is expressed as (UB, LB). The decoder 516 outputs logic levels of the selection signals Sa and Sb as in the content in FIG. 8 in each of the period T1 and period T2 depending on an amount of discharge of ink, that is, a size of a dot to be formed that is defined by the latched print data. Specifically, firstly, when the print data is (1, 1) for defining a large dot, the decoder 516 sets the selection signal Sa to the H level and the selection signal Sb to the L level in the period T1, and sets the selection signal Sa to the H level and the selection signal Sb to the L level also in the period T2. Secondly, when the print data is (0, 1) for defining a medium dot, the decoder 516 sets the selection signal Sa to the H level and the selection signal Sb to the L level in the period T1, and sets the selection signal Sa to the L level and the selection signal Sb to the H level in the period T2. Thirdly, when the print data is (1, 0) for defining a small dot, the decoder 516 sets the selection signal Sa to the L level and the selection signal Sb to the L level in the period T1, and sets the selection signal Sa to the L level and the selection signal Sb to the H level in the period T2. Fourthly, when the print data is (0, 0) for defining non-recording, the decoder 516 sets the selection signal Sa to the L level and the selection signal Sb to the H level in the period T1, and sets the selection signal Sa to the L level and the selection signal Sb to the L level in the period T2.

FIG. 10 illustrates voltage waveforms of the drive signals that are selected depending on print data and supplied to one end of the piezoelectric element 37. When the print data is (1, 1), the selection signal Sa becomes high and the selection signal Sb becomes low in the period T1, and accordingly, the transmission gate Tga is turned on and the transmission gate Tgb is turned off. With these waveforms, the trapezoidal waveform Adp1 of the drive signal Com-A is selected in the period T1. The selection signal Sa becomes high and the selection signal Sb becomes low also in the period T2, and accordingly, the trapezoidal waveform Adp2 of the drive signal Com-A is selected. When the trapezoidal waveform Adp1 is selected in the period T1, the trapezoidal waveform Adp2 is selected in the period T2, and the drive signal is supplied as the individual drive signal Vin to one end of the piezoelectric element 37, the ink of the medium amount is discharged twice from the nozzle N that corresponds to the piezoelectric element 37. These ink droplets combine on the medium 12 into a large dot as defined by the print data.

When the print data is (0, 1), the selection signal Sa becomes high and the selection signal Sb becomes low in the period T1, and accordingly, the transmission gate Tga is turned on and the transmission gate Tgb is turned off. Consequently, the trapezoidal waveform Adp1 of the drive signal Com-A is selected in the period T1. Then, the selection signal Sa becomes low and the selection signal Sb becomes high in the period T2, and the trapezoidal waveform Bdp2 of the drive signal Com-B is selected. With these waveforms, the ink of the medium amount and the ink of the small amount are discharged respectively from the nozzle. These ink droplets combine on the medium 12 into a medium dot as defined by the print data.

When the print data is (1, 0), both of the selection signals Sa and Sb become low in the period T1, and the transmission gates Tga and Tgb are turned off. Consequently, neither the trapezoidal waveform Adp1 nor the trapezoidal waveform Bdp1 is selected in the period T1. When both of the transmission gates Tga and Tgb are turned off, the path from the contact of the outputs of the transmission gates Tga and Tgb to one end of the piezoelectric element 37 becomes a high impedance state, which is an electrically disconnected state. One end of the piezoelectric element 37 is maintained at the voltage Vcen, which is the voltage immediately before the transmission gates Tga and Tgb are turned off, by the capacitive property of the piezoelectric element 37. Then, the selection signal Sa becomes low and the selection signal Sb becomes high in the period T2, and the trapezoidal waveform Bdp2 of the drive signal Com-B is selected. With this waveform, the ink of the small amount is discharged from the nozzle N only in the period T2 and a small dot is formed on the medium 12 as defined by the print data.

When the print data is (0, 0), the selection signal Sa becomes low and the selection signal Sb becomes high in the period T1, and the transmission gate Tga is turned off and the transmission gate Tgb is turned on. Consequently, the trapezoidal waveform Bdp1 of the drive signal Com-B is selected in the period T1. Then, both of the selection signals Sa and Sb become low in the period T2 and neither the trapezoidal waveform Adp2 nor the trapezoidal waveform Bdp2 is selected. With this selection, the ink around the nozzle N slightly vibrates in the period T1 and no ink is discharged and accordingly no dot is formed as defined in the non-recording according to the print data.

As described above, in the discharge circuit d in a stage, the drive signal Com-A or the drive signal Com-B is selected (or not selected) according to the print data for the stage and the selected drive signal is applied to one end of the piezoelectric element 37 (or the one end of the piezoelectric element 37 becomes a high impedance state). Such a selection operation is simultaneously performed in each stage of the small blocks A11, A12, A21, A22, B11, B12, B21, and B22. With this operation, the piezoelectric element 37 in each stage is driven depending on the amount of ink defined by the print data. Note that the drive signal Com-A and the drive signal Com-B illustrated in FIG. 6 are merely an example, and various combinations of various waveforms provided in advance may be used depending on the properties or transport speeds of the medium 12. In this embodiment, the central portion of the piezoelectric element 37 is deformed upward as the voltage of the individual drive signal Vin decreases in FIG. 4; alternatively, the piezoelectric element 37 may be deformed downward as the voltage decreases.

Now, a comparative example for comparison with the effects of the piezoelectric ink jet printer 1 according to the embodiment will be described.

Figure 12:
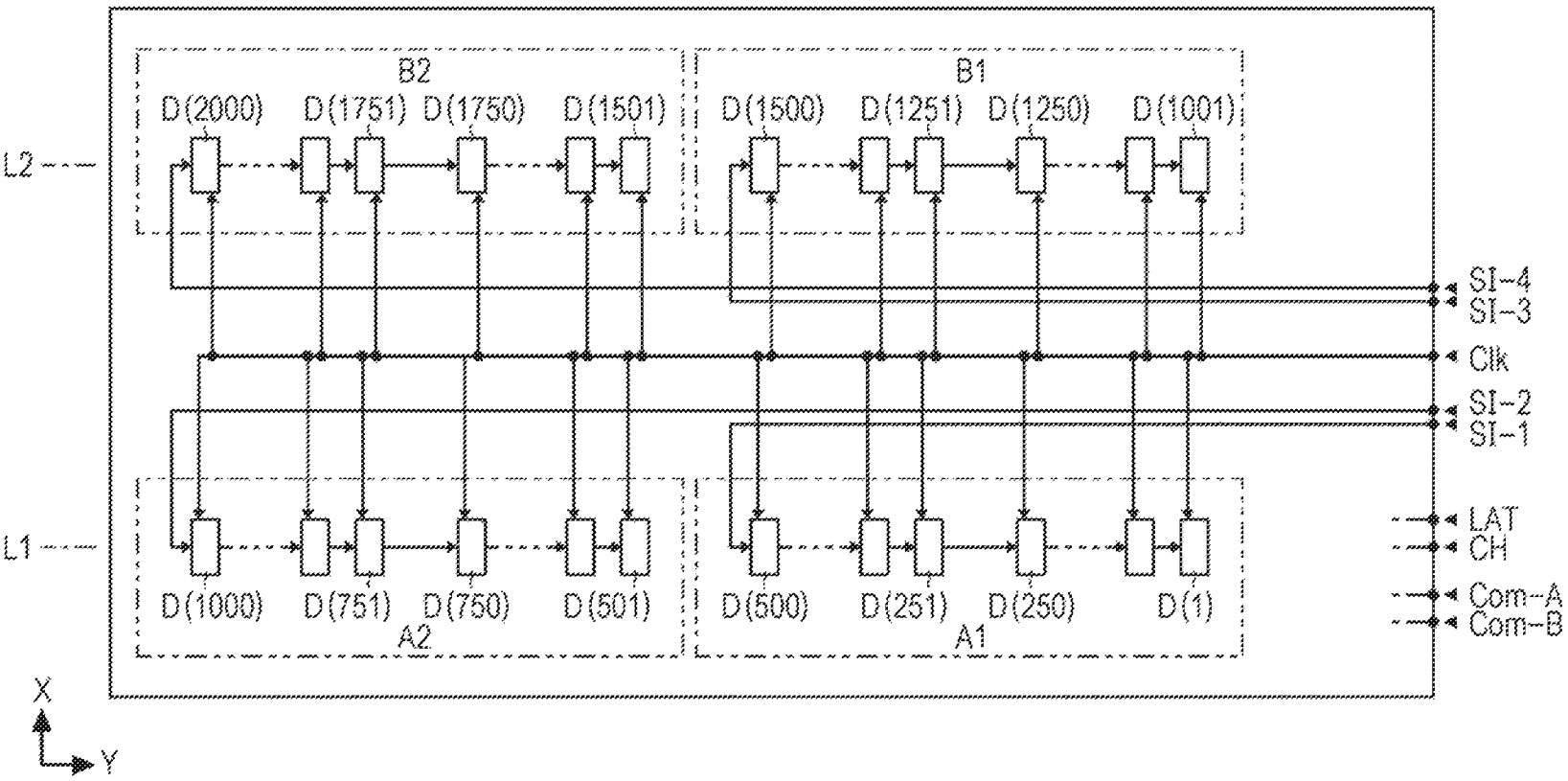
FIG. 12 is a block diagram illustrating an electric configuration of a head driver according to a comparative example.
Figure 13:
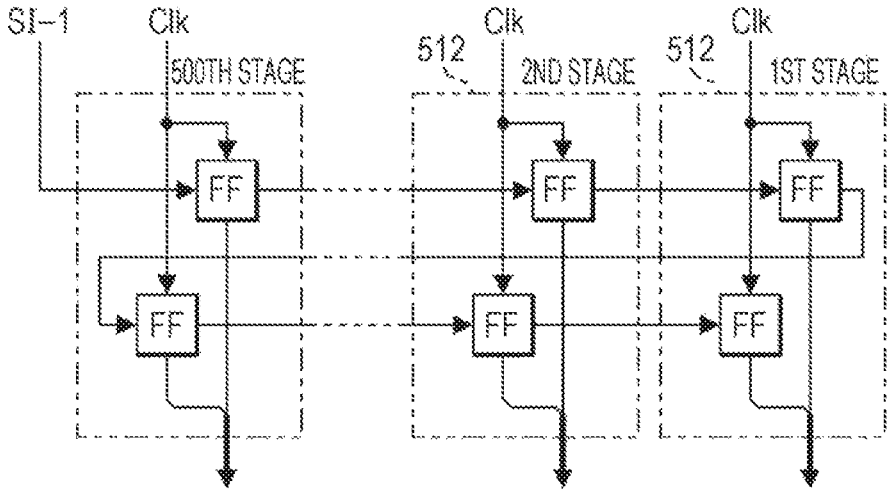
FIG. 13 illustrates a configuration of flip-flops in a discharge circuit.

FIG. 12 is a block diagram illustrating a schematic electric configuration of a head driver according to a comparative example. The configuration of the head driver illustrated in FIG. 12 is different from that in FIG. 5 in that the clock signal Clk is commonly supplied to each of the discharge circuits d(1) to d(2000) without the clock distribution circuit 502 and the discharge circuits are not divided into small blocks. In this comparative example, for example, the large block A1 includes the discharge circuits d(1) to d(500). Although not particularly illustrated, each of the discharge circuits d(1) to d(500) in the large block A1 has two flip-flops FF similarly to the above-described embodiment; however, a connection path of the flip-flops FF is different as illustrated in FIG. 13. Specifically, as illustrated in FIG. 13, the 1000 flip-flops FF in the discharge circuits d(1) to d(500) are connected in cascade starting from the 500th stage to which the print signal SI-1 is supplied, to the 499th stage (not illustrated), . . . , the second stage, the first stage, the 500th stage, the 499th stage, . . . , the second stage, and the first stage. In the comparative example, the print signal SI-1 is supplied in the order described below that is different from that in the illustrated. Specifically, the print signal SI-1 according to the comparative example sequentially defines a bit UB in the quarters Q1 and Q2 with the clock signal Clk of 500 shots and sequentially defines a bit LB in the quarters Q3 and Q4 with the clock signal Clk of 500 shots in the print data that corresponds to each nozzle in the discharge circuits d(1) to d(500).

In this comparative example, after the clock signal Clk of 1000 shots has been supplied, that is, after the quarter Q4 has been processed, similarly to the above-described embodiment, in the two flip-flops in each stage, the flip-flop FF on the upstream side stores the lower bit LB of the print data and the flip-flop FF on the downstream side stores the upper bit UB.

In this comparative example, in the quarters Q1 to Q4, the clock signal Clk is supplied to a total of 4000 flip-flops FF, the two flip-flops FF in each stage of the discharge circuits d(1) to d(2000). Accordingly, in this comparative example, in the quarters Q1 to Q4, all flip-flops FF perform the transfer operation.

In the piezoelectric ink jet printer 1 according to the embodiment, in the quarters Q1 and Q2, the clock signal Clk1 is supplied to the discharge circuit d in each stage of the small blocks A11, A21, B11, and B21; however, the clock signal Clk2 is not supplied to the discharge circuit d in each stage of the small blocks A12, A22, B12, and B22. On the other hand, in the quarters Q3 and Q4, the clock signal Clk2 is supplied to the discharge circuit d in each stage of the small blocks A12, A22, B12, and B22; however, the clock signal Clk1 is not supplied to the discharge circuit d in each stage of the small blocks A11, A21, B11, and B21. In other words, in this embodiment, in the quarters Q1 to Q4 in which the clock signal Clk is supplied to the head driver DR, in the total of 4000 flip-flops FF in the discharge circuits d(1) to d(2000), half of the 4000 flip-flops FF perform the transfer operation and the remaining half stop the transfer operation. With this configuration, the embodiment can reduce the current consumption in the head driver DR as compared to the comparative example. With the power consumption decrease, the heat generation in the piezoelectric print head HU can be reduced. As a result, the changes in the physical properties of the ink due to the temperature rise can be suppressed, there is no need to use a material that has high heat resistance for the material of the components in the ink channels, and there is no need to design the head driver DR so as to operate stably under a high temperature environment.

Furthermore, compared with the comparative example, the configuration according to the embodiment requires no change in the clock signal Clk to be supplied by the control mechanism 20. Furthermore, the print signals SI-1 to SI-4 are supplied in different order but the number of the signal lines is not changed. Accordingly, this embodiment does not require substantial changes from the configuration according to the comparative example.

In this embodiment, for example, when the nozzles N(1) to N(250) corresponding to the small block A11 are a first discharge section group, the nozzles N(251) to N(500) corresponding to the small block A12 are a second discharge section group, and the nozzles N(501) to N(750) corresponding to the small block A21 are a third discharge section group, the second discharge section group is located between the first discharge section group and the third discharge section group. In the period in which the transfer operation is performed with the clock signal Clk2 in the discharge circuits d(251) to d(500) corresponding to the second discharge section group, the transfer operation with the clock signal Clk1 is stopped in the discharge circuits d(1) to d(250) corresponding to the first discharge section group and the discharge circuits d(501) to d(750) corresponding to the third discharge section group. Accordingly, the small block that generates heat due to the transfer operation is sandwiched between the small blocks in which the transfer operation is stopped and no heat is generated, and accordingly, the heat dispersibility can be increased.

In the above-described embodiment, the clock distribution circuit 502 distributes the clock signal Clk as the clock signal Clk1 and the clock signal Clk2; however, the number of distribution of the clock signal may be three, four, or more as long as the number of distribution of the clock signal is two or more.

Figure 11:
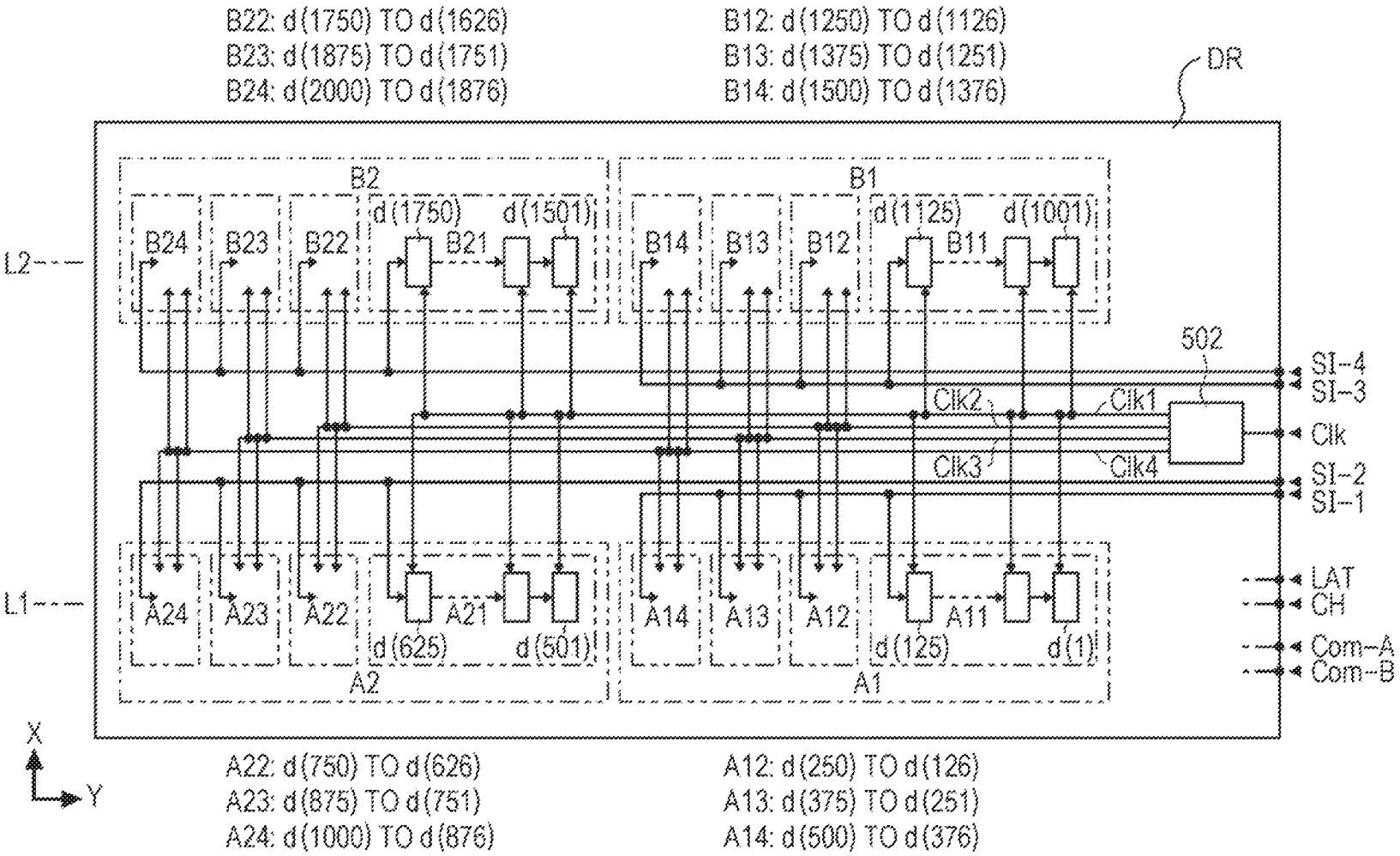
FIG. 11 is a block diagram illustrating an electric configuration of a head driver according to a modification.

FIG. 11 is a block diagram illustrating a schematic electrical configuration of a head driver DR according to a modification in which the number of distribution of the clock signal is four. A configuration of the head driver illustrated in FIG. 11 is similar to that in the configuration in FIG. 5 in that the head driver is divided into the four large blocks A1, A2, B1, and B2, however, different in that, for example, the large block A1 is divided into four small blocks A11 to A14 and the clock distribution circuit 502 distributes the clock signal Clk as clock signals Clk1 to Clk4.

The small block A11, which is one of the four divided blocks of the large block A1, is a group of the discharge circuits d(1) to d(125), the small block A12 is a group of the discharge circuits d(126) to d(250), the small block A13 is a group of the discharge circuits d(251) to d(375), and the small block A14 is a group of the discharge circuits d(376) to d(500). To each of the discharge circuits d(1) to d(125), the clock signal Clk1 is supplied, to each of the discharge circuits d(126) to d(250), the clock signal Clk2 is supplied, to each of the discharge circuits d(251) to d(375), the clock signal Clk3 is supplied, and to each of the discharge circuits d(376) to d(500), the clock signal Clk4 is supplied. The print signal SI-1 is supplied to the discharge circuits d(125), d(250), d(375), and d(500).

The clock distribution circuit 502 according to the modification distributes the clock signal Clk of 1000 shots as clock signals Clk1 to Clk4 as described below. Although not particularly illustrated, the clock distribution circuit 502 according to the modification distributes, in the clock signal Clk, 1 to 250 shots as a clock signal Clk1, 251 to 500 shots as a clock signal Clk2, 501 to 750 shots as a clock signal Clk3, and 751 to 1000 shots as a clock signal Clk4.

In this modification, the print signal SI-1 serially defines the amounts of ink to be discharged from the nozzles of the discharge sections D(1) to D(500) in the small block A11 in an order described below. Specifically, although not particularly illustrated, in the print data that corresponds to each nozzle in the discharge circuits d(1) to d(125), the print signal SI-1 according to the modification sequentially defines the bit UB in synchronization with the clock signal Clk of 1 to 125 shots and sequentially defines the bit LB in synchronization with the clock signal Clk of 126 to 250 shots. Then, in the print data that corresponds to each nozzle in the discharge circuits d(126) to d(250), the print signal SI-1 sequentially defines the bit UB in synchronization with the clock signal Clk of 251 to 375 shots and sequentially defines the bit LB in synchronization with the clock signal Clk of 376 to 500 shots. Furthermore, in the print data that corresponds to each nozzle in the discharge circuits d(251) to d(375), the print signal SI-1 sequentially defines the bit UB in synchronization with the clock signal Clk of 501 to 625 shots and sequentially defines the bit LB in synchronization with the clock signal Clk of 626 to 750 shots. Then, in the print data that corresponds to each nozzle in the discharge circuits d(376) to d(500), the print signal SI-1 sequentially defines the bit UB in synchronization with the clock signal Clk of 751 to 875 shots and sequentially defines the bit LB in synchronization with the clock signal Clk of 876 to 1000 shots.

In other words, in the flip-flop FF in each stage in the large block A1, the print signal SI-1 is sequentially transferred with the clock signal Clk1 in the discharge circuits d(1) to d(125) in the small block A11, sequentially transferred with the clock signal Clk2 in the discharge circuits d(126) to d(250), sequentially transferred with the clock signal Clk3 in the discharge circuits d(251) to d(375), and sequentially transferred with the clock signal Clk4 in the discharge circuits d(376) to d(500). Accordingly, in this modification, in the period in which the transfer operation is performed in the small block A11, the transfer operation is stopped in the small blocks A12, A13, and A14. Similarly, in the period in which the transfer operation is performed in the small block A12, the transfer operation is stopped in the small blocks A11, A13, and A14, in the period in which the transfer operation is performed in the small block A13, the transfer operation is stopped in the small blocks A11, A12, and A14, and in the period in which the transfer operation is performed in the small block A14, the transfer operation is stopped in the small blocks A11, A12, and A13.

In this modification, the large block A1 is described, and similarly in the large blocks A2, B1, and B2, while the transfer operation is performed in a small block, the transfer operation is stopped in the other three small blocks. Accordingly, in this modification, the number of flip-flops FF that perform the transfer operation is one-fourth of all stages, and the current consumption is further halved compared with the above-described embodiment, and thereby the heat generation in the piezoelectric print head HU can be further reduced.

In this modification, for example, when the nozzles N(1) to N(125) corresponding to the small block A11 are a first discharge section group, the nozzles N(126) to N(250) corresponding to the small block A12 are a second discharge section group, and the nozzles N(500) to N(625) corresponding to the small block A21 are a third discharge section group, the nozzles N(251) to N(375) corresponding to the small block A13 is the third discharge section group. The third discharge section group is located between the first discharge section group and the third discharge section group. In the period in which the transfer operation is performed with the clock signal Clk3 in the discharge circuits d(251) to d(375) corresponding to the third discharge section group, the transfer operation is stopped in the discharge circuits d(1) to d(125) corresponding to the first discharge section group, the discharge circuits d(126) to d(250) corresponding to the second discharge section group, and the discharge circuits d(501) to d(625) corresponding to the third discharge section group, and accordingly, the heat dispersibility can be increased as compared with the above-described embodiment.

The above-described embodiment may be modified in various ways. Specific modifications will be described below. Two or more modifications selected from those below may be combined without a contradiction between them. In the modifications described below, the reference numerals used in the above description will be used to components that operate or serve similarly to those in the embodiments, and detailed descriptions of the components will be omitted.

In the above description, the print period Ta is divided into the period T1 and the period T2, and the drive signal Com-A or the drive signal Com-B is selected and applied to one end of the piezoelectric element 37 (multi com); however, in the above description, the number of divisions of the print period Ta is not limited to two, and the number of drive signals is not limited to two. Alternatively, a configuration (single com) in which, from a drive signal having different trapezoidal waveforms that are repeated in a predetermined order, one or more trapezoidal waveforms are selected according to print data SI and the selected trapezoidal waveforms are applied to one end of the piezoelectric element 37 may be employed.

In the above-described embodiments, the piezoelectric ink jet printer 1 is a serial printer; however, the piezoelectric ink jet printer 1 is not limited to the serial printer. For example, the piezoelectric ink jet printer 1 may be a line printer that includes a piezoelectric print head HU that has a plurality of nozzles N and is wider than the width of the medium 12.

What is claimed is:

1. A piezoelectric print head comprising:

a first discharge section group having a plurality of first discharge sections configured to discharge liquid;

a second discharge section group having a plurality of second discharge sections configured to discharge the liquid;

a third discharge section group having a plurality of third discharge sections configured to discharge the liquid;

a first switch group having a plurality of first switches each configured to supply or not to supply a drive signal to a corresponding first discharge section to discharge the liquid;

second switch group having a plurality of second switches each configured to supply or not to supply the drive signal to a corresponding second discharge section to discharge the liquid; and third switch group having a plurality of third switches each configured to supply or not to supply the drive signal to a corresponding third discharge section to discharge the liquid, wherein the second discharge section group is located between the first discharge section group and the third discharge section group, the first switches and the third switches are switched in accordance with a print signal in synchronization with a first clock, the second switches are switched in accordance with a print signal in synchronization with a second clock, in a first period, the print signal synchronized with the second clock is transferred and the print signal synchronized with the first clock is not transferred, and in a second period, the print signal synchronized with the second clock is not transferred and the print signal synchronized with the first clock is transferred.

2. The piezoelectric print head according to claim 1, further comprising:

a clock distribution circuit configured to distribute an original clock signal as the first clock or the second clock.

3. The piezoelectric print head according to claim 1, wherein physical properties of the liquid change at less than 100° C.

4. The piezoelectric print head according to claim 1, wherein in the plurality of discharge section groups including the first discharge section group, the second discharge section group, and the third discharge section group, 400 or more discharge sections are arrayed in rows at a density of 300 or more per inch, and switches that correspond to the respective 400 or more discharge sections are provided.

5. The piezoelectric print head according to claim 1, further comprising:

a fourth discharge section group having a plurality of fourth discharge sections configured to discharge the liquid; and a fourth switch group having a plurality of fourth switches each configured to supply or not to supply the drive signal to the fourth discharge section to discharge the liquid, wherein the fourth discharge section group is located between the first discharge section group and the third discharge section group, the fourth switches are switched in accordance with a print signal in synchronization with a third clock, and in a third period, the print signals synchronized with the first clock and the second clock are not transferred and the print signal synchronized with the third clock is transferred.

6. A piezoelectric printer comprising:

a first discharge section group having a plurality of first discharge sections configured to discharge liquid onto a medium;

a second discharge section group having a plurality of second discharge sections configured to discharge the liquid onto the medium;

a third discharge section group having a plurality of third discharge sections configured to discharge the liquid onto the medium;

a first switch group having a plurality of first switches each configured to supply or not to supply a drive signal to a corresponding first discharge section to discharge the liquid;

second switch group having a plurality of second switches each configured to supply or not to supply the drive signal to a corresponding second discharge section to discharge the liquid;

third switch group having a plurality of third switches each configured to supply or not to supply the drive signal to a corresponding third discharge section to discharge the liquid; and a transport section configured to transport the medium, wherein the second discharge section group is located between the first discharge section group and the third discharge section group, the first switches and the third switches are switched in accordance with a print signal in synchronization with a first clock, the second switches are switched in accordance with a print signal in synchronization with a second clock, in a first period, the print signal synchronized with the second clock is transferred and the print signal synchronized with the first clock is not transferred, and in a second period, the print signal synchronized with the second clock is not transferred and the print signal synchronized with the first clock is transferred.

7. The piezoelectric printer according to claim 6, further comprising:

a clock distribution circuit configured to distribute an original clock signal as the first clock or the second clock.

8. The piezoelectric printer according to claim 6, wherein physical properties of the liquid change at less than 100° C.

9. The piezoelectric printer according to claim 6, wherein in the plurality of discharge section groups including the first discharge section group, the second discharge section group, and the third discharge section group, 400 or more discharge sections are arrayed in rows at a density of 300 or more per inch, and switches that correspond to the respective 400 or more discharge sections are provided.

10. The piezoelectric printer according to claim 6, further comprising:

a fourth discharge section group having a plurality of fourth discharge sections configured to discharge the liquid; and a fourth switch group having a plurality of fourth switches each configured to supply or not to supply the drive signal to the fourth discharge section to discharge the liquid, wherein the fourth discharge section group is located between the first discharge section group and the third discharge section group, the fourth switches are switched in accordance with a print signal in synchronization with a third clock, and in a third period, the print signals synchronized with the first clock and the second clock are not transferred and the print signal synchronized with the third clock is transferred.

* * * * *